US007393415B2

(12) United States Patent
Obata et al.

(10) Patent No.: US 7,393,415 B2
(45) Date of Patent: Jul. 1, 2008

(54) METHOD AND APPARATUS FOR APPLYING COATING LIQUID TO CYLINDRICAL SUBSTRATE AND METHOD FOR PRODUCING ELECTROPHOTOGRAPHIC PHOTORECEPTOR AND ELECTROPHOTOGRAPHIC PHOTORECEPTOR PRODUCED BY THE PRODUCTION METHOD

(75) Inventors: Takatsugu Obata, Nara (JP); Hisayuki Utsumi, Nara (JP); Junichi Washo, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 651 days.

(21) Appl. No.: 10/942,096

(22) Filed: Sep. 16, 2004

(65) Prior Publication Data

US 2005/0112278 A1 May 26, 2005

(30) Foreign Application Priority Data

Sep. 19, 2003 (JP) ..... P2003-328828

(51) Int. Cl.
*B05C 11/10* (2006.01)

(52) U.S. Cl. ..... 118/668; 118/712; 118/232; 118/244; 118/247; 118/261; 118/262

(58) Field of Classification Search ..... 118/668, 118/712, 232, 244, 247, 261, 262, DIG. 14
See application file for complete search history.

(56) References Cited

U.S. PATENT DOCUMENTS 3,989,937 A * 11/1976 Fay et al. ..... 700/123
2007/0137506 A1* 6/2007 Chesnut et al. ..... 101/153

FOREIGN PATENT DOCUMENTS

| | | | |
|---|---|---|---|
| JP | 3-12261 | A | 1/1991 |
| JP | 11-38651 | A | 2/1999 |
| JP | 11-216405 | A | 8/1999 |
| JP | 11-235543 | A | 8/1999 |
| JP | 11-276958 | A | 10/1999 |
| JP | 2000-84472 | A | 3/2000 |
| JP | 2000-325862 | A | 11/2000 |
| JP | 2000-325863 | A | 11/2000 |

* cited by examiner

*Primary Examiner*—George Koch
(74) *Attorney, Agent, or Firm*—Nixon & Vanderhye P.C.

(57) ABSTRACT

To suppress generation of a joint when detaching an applicator roll and cylindrical substrate from each other in a simple control to form a coating film having a uniform thickness efficiently on the cylindrical substrate is provided. A coating liquid is supplied from a pan to an applicator roll via a metalling roll, the applicator roll supplied with the coating liquid and a cylindrical substrate provided so as to be close to or in contact with the applicator roll are rotated. The coating liquid is transferred from the applicator roll to the cylindrical substrate, and the cylindrical substrate is rotated in a predetermined number. Thereafter, such control is carried out that the circumferential speed V1 of one of the applicator roll and the cylindrical substrate is higher than the circumferential speed V2 of the other when detaching the applicator roll and the cylindrical substrate from each other.

4 Claims, 14 Drawing Sheets

METHOD AND APPARATUS FOR APPLYING COATING LIQUID TO CYLINDRICAL SUBSTRATE AND METHOD FOR PRODUCING ELECTROPHOTOGRAPHIC PHOTORECEPTOR AND ELECTROPHOTOGRAPHIC PHOTORECEPTOR PRODUCED BY THE PRODUCTION METHOD

BACKGROUND OF THE INVENTION

1. Field of the Invention

The present invention relates to a method and an apparatus for applying a coating liquid to a cylindrical substrate. In particular, the present invention relates to a method for producing an electrophotographic photoreceptor that is used in an image forming apparatus such as copiers, printers, and facsimiles and produced by applying a coating liquid to a cylindrical conductive support.

2. Description of the Related Art

An electrophotographic photoreceptor used in an image forming apparatus such as copiers, printers, and facsimiles is formed by applying a photosensitive layer to an outer circumferential surface of a hollow cylindrical conductive support. In recent years, as a result of in-depth development in response to demand for high performance, many of the electrophotographic photoreceptors are provided with a photosensitive layer having a laminated structure in which an intermediate layer, a charge-generating layer and a charge-transporting layer, and further a protective layer for improving the durability as its outer layer in some photoreceptors, are applied sequentially.

In this specification, a layer constituted by an intermediate layer, a charge-generating layer, a charge-transporting layer and a protective layer is collectively referred to as a sensitive layer. The intermediate layer and/or the protective layer are provided for the purpose of improving the performance of an electrophotographic photoreceptor, and are not essential, so that a layer consisting of a charge-generating layer and a charge-transporting layer and a layer in which a charge-generating layer and a charge-transporting layer are constituted as one layer are also referred to as a photosensitive layer.

The photosensitive layer provided in the electrophotographic photoreceptor is required to be a thin film and have a uniform thickness. Therefore, new application methods have been under development and examination in order to realize higher performance by applying an even thinner photosensitive layer with uniform thickness and to allow application at low cost.

As a method for applying a photosensitive layer to the outer circumferential surface of a conductive support that is an original pipe for an electrophotographic photoreceptor, spray coating, immersion coating, blade coating and the like are conventionally known. However, conventionally known application methods have problems such as inability of providing uniform coating films or poor production efficiency.

For example, in spraying coating, coating is performed by spraying a coating liquid from a spray nozzle in the form of fine particles, and therefore the appearance after coating is good. However, since a thickness of a layer formed by one coating is small, it is necessary to repeat coating a plurality of times in order to obtain a desired thickness. Furthermore, when a large amount of coating liquid is used for coating, the coating liquid is dropped, and a coating layer with non-uniform thickness is formed. In addition, since the volatile component in the coating liquid is easily vaporized when the coating liquid is sprayed for coating, the viscosity of the coating liquid is increased and orange peel (a phenomenon in which a orange skin-like swell occurs) occurs in the formed coating layer.

In immersion coating, a cylindrical conductive support that is an original pipe for an electrophotographic photoreceptor is immersed with one end thereof held and the axis of the cylinder being perpendicular to the liquid surface of the coating liquid, and then lifted from the coating liquid. Thus, a photosensitive layer is applied onto the surface of the conductive support, and this method is often used to produce an electrophotographic photoreceptor. However, the thickness of the layer (also referred to as "film thickness") that is applied by immersion coating depends significantly on the lifting speed at which the conductive support is lifted from the coating liquid, the viscosity of the coating liquid, and the speed at which the volatile component contained in the coating liquid evaporates. Therefore, these factors have to be controlled strictly. Furthermore, since the conductive support is lifted from the coating liquid in the vertical direction, the coating liquid flows down along the surface of the conductive support by gravity effect, and the film thickness of the conductive support on the upper side in the lifting direction is smaller than that on the lower side.

In order to solve the problem of non-uniformity of the film thickness, it is necessary to control the lifting speed strictly. However, the control is difficult, and furthermore in order to form a coating film having a uniform thickness, the lifting speed after immersion has to be slow, which is a basic problem. Furthermore, a coating film is formed on the internal portion and the end face of the conductive support, for which coating is not necessary, and therefore it is necessary to peel the coating film formed on the internal portion and the end face. Moreover, since the conductive support is immersed in the coating liquid, it is necessary that a bath for storing a coating liquid contains constantly the coating liquid in an amount sufficient for the total length of the conductive support to be immersed. Thus, since the coating liquid in an amount that exceeds the amount necessary for coating and forming a film is constantly prepared, the use efficiency of the coating liquid becomes poor. Then, in order to improve the use efficiency, instead of preparing a new coating liquid for each occasion of use, a coating liquid that is newly produced is added in a necessary amount to the coating liquid contained in the storage bath that already has been used, and thus the same coating liquid is used many times. However, the viscosity and the characteristics of the coating liquid are changed over time and are changed with a fine difference from those of the newly added coating liquid. Therefore, the application conditions have to be optimized for each coating operation, which decreases the work efficiency.

In blade coating, in view of a conductive support, a blade is positioned near the conductive support and a coating liquid is supplied to the blade. Then, the coating liquid is applied onto the conductive support with the blade, and the blade is withdrawn after one rotation of the conductive support. This method provides high productivity, but when the blade is withdrawn, a part of the coating film applied to the conductive support is protruded by surface tension of the coating liquid and the film thickness becomes non-uniform.

As another method than the above, there is a roll coating method. In this method, a film of a coating liquid with a regulated thickness is formed on an applicator roll, and while a conductive support located near or in contact with the applicator roll and the applicator roll are rotated, the coating liquid is transferred and applied from the applicator roll to the conductive support. However, also in the roll coating method, when detaching the conductive support from the applicator roll after coating, so-called a liquid trailing phenomenon, that is, a phenomenon in which extra coating liquid is attached to the conductive support by the surface tension of the coating liquid tends to occur, and a joint remains in the coating film because of this liquid trailing phenomenon, and the film thickness becomes non-uniform. As a result, defects occur in the images. Herein, "joint" refers to a portion in which the film thickness is non-uniform because extra coating liquid is attached when detaching the conductive support from the applicator roll.

There are conventional techniques for preventing the occurrence of this joint that have been proposed. For example, after a cylindrical substrate is rotated once or more times and coating is ended, the cylindrical substrate is detached from the coating material supplying roll, and it is attempted to achieve leveling (making the film thickness uniform) by allowing the cylindrical substrate to continue to rotate (see Japanese Unexamined Patent Publication JP-A 3-12261 (1991)). However, in the method disclosed in JP-A 3-12261, it is necessary to perform precise control of film thickness, estimating the amount of coating material storage to be leveled in advance, and it is difficult to eliminate the joint completely.

Moreover, there is a method for preventing the occurrence of a joint by decreasing the film thickness of coating material on the applicator roll when detaching between the applicator roll and the cylindrical substrate from each other after application (see Japanese Unexamined Patent Publication JP-A 11-216405 (1999)). Furthermore, there is a method in which after coating, the relationship between the film thickness of the coating material on the applicator roll and the gap formed by the applicator roll and the cylindrical substrate is defined, and the amount of the coating material on the applicator roll is reduced from this state, and the linkage of the coating material between the applicator roll and the cylindrical substrate is cut (see Japanese Unexamined Patent Publication JP-A 2000-325863). However, in the methods disclosed either in JP-A 11-216405 or JP-A 2000-325863, the joint cannot be eliminated to such an extent that defects in the images are suppressed completely. Furthermore, in these methods, it is necessary to control the application conditions strictly at the time of application and detachment, so that high production efficiency cannot be expected.

Furthermore, there is a method of controlling the speed at which the applicator roll and the cylindrical substrate are detached from each other after coating (see Japanese Unexamined Patent Publication JP-A 11-276958 (1999)). However, also in the method disclosed in JP-A 11-276958 as well as in the methods in JP-A 11-216405 or JP-A 2000-325863, the joint cannot be eliminated to such an extent that defects in the images are suppressed completely.

Furthermore, there is a method of forming a rib in a coating film by changing the circumferential speed between the applicator roll and the cylindrical substrate and detaching the applicator roll and the cylindrical substrate from each other in that state (see Japanese Unexamined Patent Publication JP-A 2000-84472). However, in the method disclosed in JP-A 2000-84472, since a rib is formed in the coating film, there are problems described below. That is, when a solvent having a low boiling point is used, the leveling time to eliminate the rib and make the thickness uniform is not sufficient and therefore the coating film swells in waves. When a solvent having a high boiling point is used, the leveling time can be sufficient, but drying takes a long time, which deteriorates the production efficiency significantly. Furthermore, it is necessary to determine strictly the various conditions such as the roll diameter, the circumferential speed, the gap, the coating material viscosity, the surface tension, etc., in order to form a rib, so that it is difficult to determine the application conditions, and the acceptable range for setting of the composition of the coating liquid or apparatus structure is limited. In particular, since the thickness formed as a charge-generating layer and an intermediate layer is small, it is very difficult to set the conditions for forming a rib and even if a rib is formed, it dries in a short time, and a sufficient time for leveling cannot be ensured. As a result, it is difficult to obtain a layer having a uniform film thickness.

SUMMARY OF THE INVENTION

An object of the invention is to provide a method and an apparatus for applying a coating liquid to a cylindrical substrate for forming a coating film having a uniform thickness on the cylindrical substrate efficiently while preventing generation of a joint when detaching the applicator roll and the cylindrical substrate from each other in a simple control.

Another object of the invention is to provide a method for producing a electrophotographic photoreceptor for forming a photosensitive layer having a uniform thickness on a conductive support efficiently while preventing a joint when detaching the applicator roll and the conductive support from each other in a simple control, and an electrophotographic photoreceptor produced by this method.

The invention provides a method for applying a coating liquid to a cylindrical substrate by transferring the coating liquid supplied to an applicator roll from the applicator roll to the cylindrical substrate, comprising:

when detaching the applicator roll and the cylindrical substrate from each other after the applicator roll and the cylindrical substrate are rotated and the coating liquid is transferred from the applicator roll to the cylindrical substrate, carrying out such control that a circumferential speed V1 of one of the applicator roll and the cylindrical substrate is higher than a circumferential speed V2 of the other of the applicator roll and the cylindrical substrate.

In the invention, a ratio R (=V1/V2) of the circumferential speed V1 that is higher of the one of the applicator roll and the cylindrical substrate and the circumferential speed V2 that is lower of the other is 1.2 or more and 15.0 or less.

In the invention, the circumferential speed V1 that is higher of the one of the applicator roll and the cylindrical substrate is the circumferential speed of the cylindrical substrate, and the circumferential speed V2 that is lower of the other is the circumferential speed of the applicator roll.

In the invention, after the applicator roll and the cylindrical substrate are detached from each other, the cylindrical substrate remains rotated for a predetermined period of time.

The invention provides an apparatus for applying a coating liquid to a cylindrical substrate by transferring the coating liquid supplied to an applicator roll from the applicator roll to the cylindrical substrate, comprising:

an applicator roll;

coating liquid supplying means for supplying a coating liquid to the applicator roll;

mounting means for mounting a cylindrical substrate removably thereon;

first driving means for rotating the cylindrical substrate mounted on the mounting means;

second driving means for rotating the applicator roll;

first circumferential speed detecting means for detecting a circumferential speed at which the cylindrical substrate is rotated;

second circumferential speed detecting means for detecting a circumferential speed at which the applicator roll is rotated;

rotation number detecting means for detecting a number of rotations of the cylindrical substrate;

detaching means capable of moving the cylindrical substrate so as to be close to or away from the applicator roll; and controlling means for controlling, in response to a detection output from the rotation number detecting means, an operation of the detaching means so as to move the cylindrical substrate away from the applicator roll, and an operation of the first and the second driving means so that a circumferential speed of one of a circumferential speed at which the cylindrical substrate is rotated and a circumferential speed at which the applicator roll is rotated is higher than a circumferential speed of the other of the circumferential speed at which the cylindrical substrate is rotated and the circumferential speed at which the applicator roll.

In the invention, the apparatus further comprises film thickness adjusting means for adjusting a film thickness of the coating liquid supplied to the applicator roll.

In the invention, the film thickness adjusting means comprises a cylindrical member opposed to the applicator roll and an adjusting member for adjusting a gap between the cylindrical member and the applicator roll.

In the invention, at least the surface layer of the applicator roll is made of an elastic material, while the coating liquid is transferred from the applicator roll to the cylindrical substrate, a rotation direction of the cylindrical substrate by the first driving means is opposite to a rotation direction of the applicator roll by the second driving means, and the cylindrical substrate and the applicator roll are arranged so as to come in contact with each other via the coating liquid.

The invention provides a method for producing an electrophotographic photoreceptor comprising:

applying a coating liquid that is supplied to an applicator roll and forms a photosensitive layer of an electrophotographic photoreceptor, to a conductive support by transferring the coating liquid from the applicator roll thereto, the method comprising:

when detaching the applicator roll and the conductive support from each other after the applicator roll and the conductive support are rotated and the coating liquid for forming a photosensitive layer is transferred from the applicator roll to the conductive support, carrying out such control that a circumferential speed V1 of one of the applicator roll and the conductive support is higher than a circumferential speed V2 of the other of the applicator roll and the conductive support.

In the invention, a ratio R (=V1/V2) of the circumferential speed V1 that is higher of the one of the applicator roll and the conductive support to the circumferential speed V2 that is lower of the other is 1.2 or more and 15.0 or less.

In the invention, the photosensitive layer is made of a laminated structure of at least two layers including a charge-transporting layer containing a charge-transporting substance and a charge-generating layer containing a charge-generating substance, and the coating liquid is a charge-transporting layer-forming coating liquid for forming a charge-transporting layer.

In the invention, the coating liquid is a protective layer-forming coating liquid for forming a protective layer constituting the outermost layer of the photosensitive layer.

In the invention, the protective layer is a resin layer made of resin.

The invention provides an electrophotographic photoreceptor produced by any one of the above-described methods for producing an electrophotographic photoreceptor.

The invention provides an image forming apparatus provided with the above-mentioned electrophotographic photoreceptor.

According to the invention, when detaching the applicator roll and the cylindrical substrate from each other after the applicator roll and the cylindrical substrate are rotated and the coating liquid is transferred from the applicator roll to the cylindrical substrate, such control is carried out that the circumferential speed V1 of the one of the applicator roll and the cylindrical substrate is higher than the circumferential speed V2 of the other, preferably, the ratio R (=V1/V2) of the circumferential speed V1 that is higher to the circumferential speed V2 that is lower is 1.2 or more and 15.0 or less. Thus, with the simple control of providing a difference in the circumferential speed, when detaching the applicator roll and the cylindrical substrate from each other, generation of liquid trailing phenomenon by the coating liquid on the applicator roll and the coating liquid on the cylindrical substrate can be prevented. Therefore, a coating film with uniform thickness having no joint can be formed on the cylindrical substrate.

Furthermore, according to the invention, the cylindrical substrate V1 that is higher of the one of the applicator roll and the cylindrical substrate is set to be the circumferential speed of the cylindrical substrate, and the circumferential speed V2 that is lower of the other is set to be the circumferential speed of the applicator roll. When a roll coating is used, it is common to set the diameter of the applicator roll to be larger than the diameter of the cylindrical substrate, which is an object to be coated. In this case, it is possible to realize the control of providing a difference in the circumferential speed in an even simpler manner by selecting such that the cylindrical substrate having a smaller diameter is rotated in a higher circumferential speed.

Furthermore, according to the invention, after the applicator roll and the cylindrical substrate are detached from each other, the cylindrical substrate remains rotated for a predetermined period of time. Therefore, in the case where the solvent of the coating liquid has a high boiling point and the coating liquid still has flowability even after the applicator roll and the cylindrical substrate are detached from each other, the surface of the coating film is dried during the rotation and dropping of the coating film due to the gravity effect is prevented and a uniform coating film can be formed.

Furthermore, according to the invention, in an apparatus for applying a coating liquid to a cylindrical substrate, such control can be carried out that, in response to a detection output from the rotation number detecting means, the cylindrical substrate is moved away from the applicator roll, and the circumferential speed of the one of the circumferential speed at which the cylindrical substrate is rotated and the circumferential speed at which the applicator roll is rotated is higher than the circumferential speed of the other. Thus, since a uniform coating film having no joint can be formed on the cylindrical substrate in a simple control, an application apparatus preferable for production of, for example, an electrophotographic photoreceptor, a developing roller, a charging roller having a coating film with uniform thickness can be provided.

Furthermore, according to the invention, since the apparatus further includes film thickness adjusting means for adjusting the film thickness of the coating liquid supplied to the applicator roll, coating films having a wide range of thickness can be formed, and for example, coating films having a uniform thickness in the wide range of a charge-generating layer (thickness of 0.1 to 1 μm) to a charge-transporting layer (several tens μm) of a laminated type electrophotographic photoreceptor can be formed by the same application apparatus. Preferably, the film thickness adjusting means includes a cylindrical member opposed to the applicator roll and an adjusting member for adjusting a gap between the cylindrical member and the applicator roll. Thus, although this has a simple structure, the thickness can be controlled so as to be uniform in the axis direction of the cylindrical substrate with high precision. Furthermore, the thickness can be controlled by the number of rotations of the cylindrical member of the film thickness adjusting means and the gap between the cylindrical member and the applicator roll. Therefore, the thickness can be controlled to be thinner with higher precision.

Furthermore, according to the invention, the application apparatus has a structure of so-called natural roll coating in which at least the surface layer of the applicator roll is made of an elastic material; while the coating liquid is transferred from the applicator roll to the cylindrical substrate, the rotation direction of the cylindrical substrate is opposite to the rotation direction of the applicator roll; and the cylindrical substrate and the applicator roll are arranged so as to come in contact with each other via the coating liquid. Thus, a very thin coating film can be formed with a uniform thickness.

Unlike the natural roll coating, in a method of applying a coating liquid by spacing the applicator roll away from the cylindrical substrate with a specific gap, the size precision of the cylindrical substrate itself or the precision of the driving means may cause a displacement in rotation, and when such a displacement in rotation occurs, it is difficult to obtain a uniform thickness, especially for a thin coating film.

On the other hand, in the application apparatus having a structure of natural roll coating, the applicator roll and the cylindrical substrate that are elastic members are in contact with each other with nip pressure. Therefore, the displacement in rotation as described above is absorbed by the elastic material of the application roll surface portion to such an extent that it can be ignored, and thus a very thin coating film can be formed uniformly. For example, thin films (0.1 to several μm) such as an intermediate layer and a charge-generating layer in the photosensitive layer of a laminated type electrophotographic photoreceptor can be formed by coating with uniform thickness.

Furthermore, since the applicator roll and the cylindrical substrate whose surface layer portion are made of elastic material are in contact with each other with nip pressure. Therefore, the applicator roll serves as a fiction member and when the rotation torque of the applicator roll is larger than the rotation torque of the cylindrical substrate, the circumferential speed of the cylindrical substrate is limited to the circumferential speed of the applicator roll. The cylindrical substrate is detached in this state where the applicator roll and the cylindrical substrate are rotated in contact with each other, the frictional force that has acted on the applicator roll and the cylindrical substrate is eliminated at the same time of the detachment. When the frictional force is eliminated, the cylindrical substrate is rotated at a circumferential speed according to the output from the driving source, regardless of the circumferential speed of the applicator roll. Therefore, by previously setting the circumferential speed of the applicator roll and the circumferential speed of the cylindrical substrate by respective driving means to be different, the circumferential speed of the cylindrical substrate can be changed instantly at the same time of detachment without providing a signal for controlling the circumferential speed of the cylindrical substrate at the time of detachment.

According to the invention, a photosensitive layer with uniform thickness having no joint can be formed by using a conductive support as the cylindrical substrate, using a coating liquid for forming a photosensitive layer of an electrophotographic photoreceptor as the coating liquid, that is, a coating liquid for forming an photosensitive layer in which electrostatic latent images are formed by exposure to light corresponding to image information, as the coating liquid. Thus, a method for producing an electrophotographic photoreceptor having no image defects can be provided.

According to the invention, the photosensitive layer of an electrophotographic photoreceptor has a laminated structure of at least two layers including a charge-transporting layer containing a charge-transporting substance and a charge-generating layer containing a charge-generating substance, and a charge-transporting layer-forming coating liquid for forming a charge-transporting layer is used as the coating liquid to roll-coat a charge-transporting layer. The charge-transporting layer constitutes the outermost layer of the photosensitive layer or a layer nearest to the outermost layer, and therefore abrasion resistance is required. The improvement of the abrasion resistance is correlated with the increase of the viscosity of the coating liquid for forming a charge-transporting layer, and roll coating is suitable to apply a coating liquid having high viscosity, that is, to form a charge-transporting layer. Furthermore, when the photosensitive layer is constituted by a laminated structure including a charge-generating layer containing a charge-generating substance and a charge-transporting layer containing a charge-transporting substance, it is possible to select an optimal material for each of the charge-generating function and the charge-transporting function. Therefore, a highly sensitive electrophotographic photoreceptor having high durability with increased stability in repeated use can be obtained. Furthermore, when specific functions are provided to different layers, and the layers are laminated, then the comprehensive functions can be exhibited. Therefore, an even higher functional electrophotographic photoreceptor can be obtained.

According to the invention, a protective layer-forming coating liquid for forming a protective layer is used as the coating liquid to roll-coat the protective layer. In general, the protective layer contains resin curable by heat or light, an inorganic oxide by a sol-gel method, and is formed by utilizing a curing reaction or a gelatinization reaction. Therefore, since the coating liquid for forming a protective layer contains a curing agent or a gelatinizer, a reaction proceeds little by little during storage of the coating liquid in a bath. As a result, the pot life of the coating liquid is shortened, and the coating liquid has to be exchanged in a short time, although the coating liquid in a large amount has to be produced in the immersion coating. By roll-coating the coating liquid for forming a protective layer, it is sufficient to produce the coating liquid in an amount necessary for coating. Therefore, there is no problem regarding the pot life of the solution. Unlike the case of the immersion coating, it is not necessary to supplement and store the coating liquid in the bath, so that the use efficiency of the coating solution can be high.

According to the invention, an electrophotographic photoreceptor is produced by any one of the above-described production methods, so that a photosensitive layer having no joints and having uniform thickness can be obtained. Thus, the photosensitive layer is uniform, and therefore when electrostatic latent images are formed by exposure of the photosensitive layer, further when a developer is supplied to the electrostatic latent images to form images, generation of image defects is prevented.

According to the invention, an image forming apparatus is provided with the electrophotographic photoreceptor produced by any one of the above-described methods for producing an electrophotographic photoreceptor, so that an image forming apparatus in which there is no image defect can be realized.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
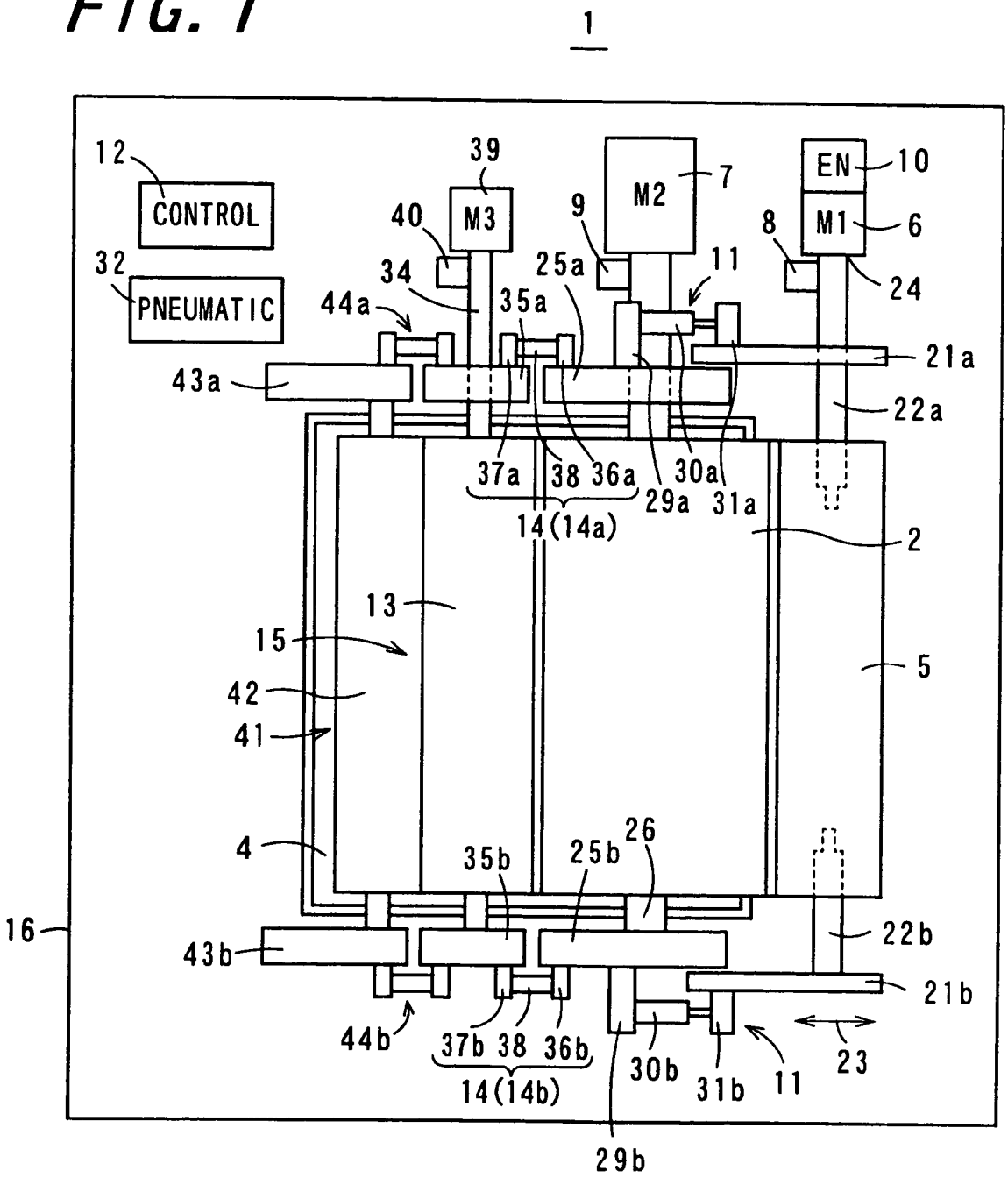
FIG. 1 is a plan view schematically showing the configuration of an apparatus for applying a coating liquid to a cylindrical substrate according to a first embodiment of the invention.

Now referring to the drawings, preferred embodiments of the invention are described below.

Figure 2:
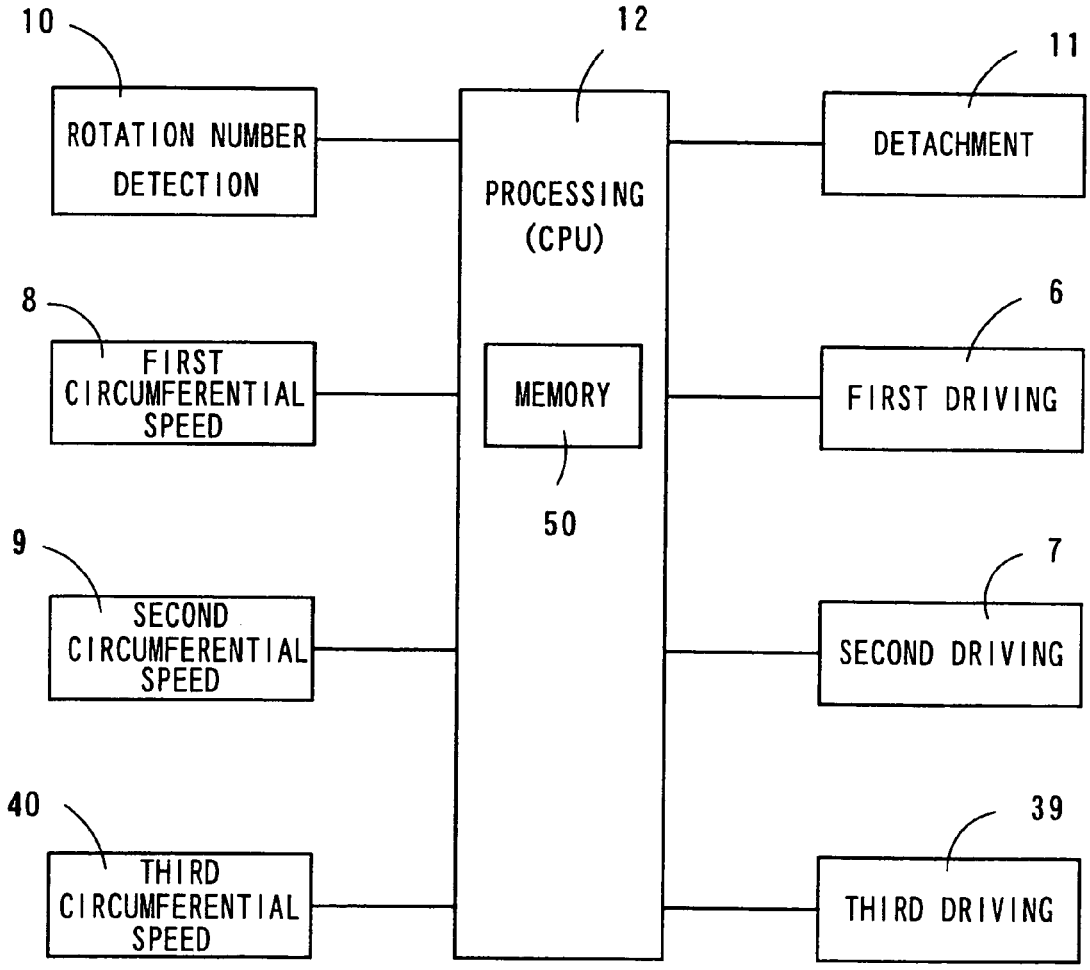
FIG. 2 is a block diagram schematically showing electrical connection of the apparatus for applying a coating liquid to a cylindrical substrate shown in FIG. 1.
Figure 3:
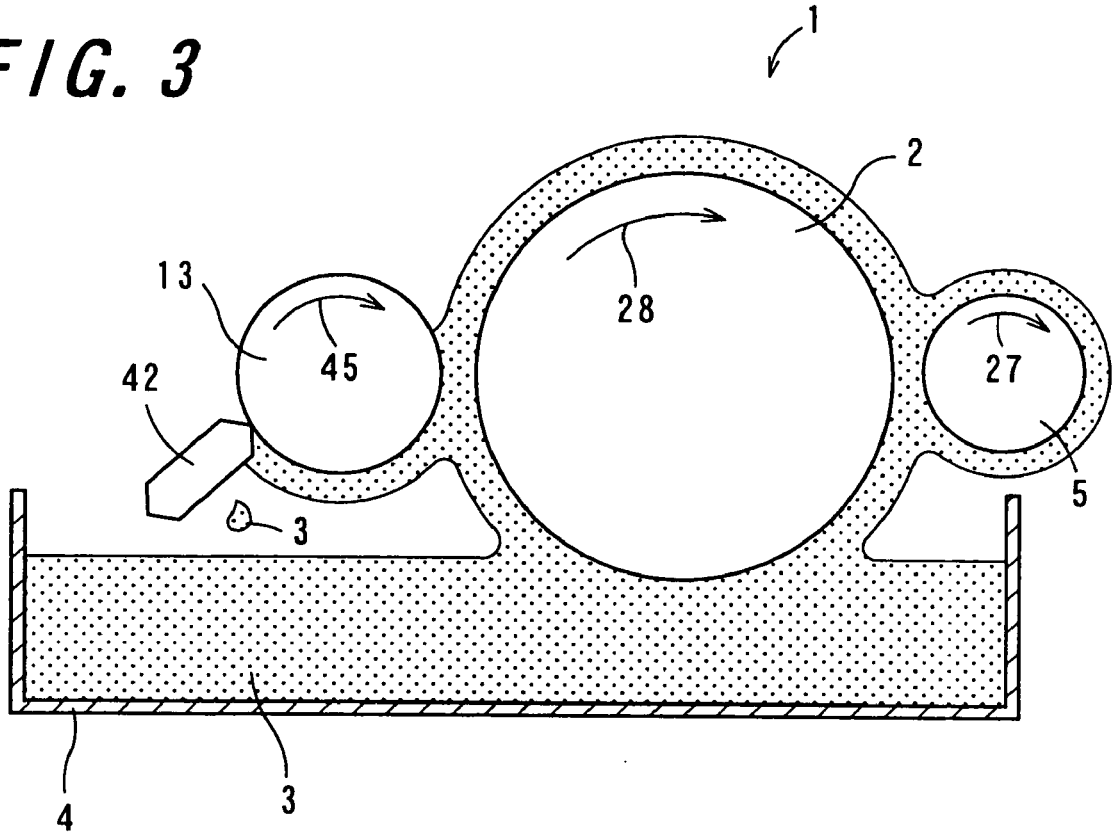
FIG. 3 is a partial cross-sectional view of the apparatus for applying a coating liquid to a cylindrical substrate shown in FIG. 1.

FIG. 1 is a plan view schematically showing the configuration of an apparatus 1 for applying a coating liquid to a cylindrical substrate according to a first embodiment of the invention, FIG. 2 is a block diagram schematically showing electrical connection of the apparatus 1 for applying a coating liquid to a cylindrical substrate shown in FIG. 1 and FIG. 3 is a partial cross-sectional view of the apparatus 1 for applying a coating liquid to a cylindrical substrate shown in FIG. 1.

An apparatus 1 for applying a coating liquid to a cylindrical substrate (hereinafter, referred to as "application apparatus 1") includes an applicator roll 2, coating liquid supplying means 4, mounting means, first driving means 6, second driving means 7, first circumferential speed detecting means 8, second circumferential speed detecting means 9, rotation number detecting means 10, detaching means 11, control means 12 and film thickness adjusting means 15. The coating liquid supplying means 4 supplies a coating liquid 3 to the applicator roll 2. The coating liquid 3 is transferred from the applicator roll 2 to the cylindrical substrate 5. The first driving means 6 rotates the cylindrical substrate 5. The second driving means 7 rotates the applicator roll 2. The first circumferential speed detecting means 8 detects a circumferential speed at which the cylindrical substrate 5 is rotated. The second circumferential speed detecting means 9 detects a circumferential speed at which the applicator roll 2 is rotated. The rotation number detecting means 10 detects a number of rotation of the cylindrical substrate 5. The detaching means 11 can move the cylindrical substrate 5 so as to be close to or away from the applicator roll 2. The control means 12 controls, in response to a detection output from the rotation number detecting means 10, the operation of the detaching means 11 so as to move the cylindrical substrate 5 away from the applicator roll 2 and the operation of the first and the second driving means 6, 7 so that the circumferential speed of the one of the circumferential speed at which the cylindrical substrate 5 is rotated and the circumferential speed at which the applicator roll 2 is rotated is higher than the other. The film thickness adjusting means 15 includes a cylindrical member 13 opposed to the applicator roll 2 and an adjusting member 14 for adjusting a gap between the cylindrical member 13 and the applicator roll 2. Each member is provided on a base stand 16.

A pair of first chocks 21*a*, 21*b* are provided on the base stand 16, bearings (not shown) are provided in the first chocks 21*a*, 21*b*, and a pair of shaft members 22*a*, 22*b* are supported rotatably in the bearings, respectively. The mounting means are constituted by the pair of first chocks 21*a* and 20*b*, bearings and the pair of shaft members 22*a* and 22*b*. The cylindrical substrate 5 is mounted removably on the shaft members 22*a*, 22*b* supported by the first chocks 21*a*, 21*b* via the bearings. The first chocks 21*a*, 21*b* are provided so as to be on a track (not shown) on the base stand 16 and can be moved in the direction 23 shown by the arrow that is the direction orthogonal to an axis of the cylindrical substrate 5 by being guided by the track.

The end portion 24 of one shaft member 22*a*, which is on a side opposite to the side on which the cylindrical substrate 5 is mounted, is coupled to an output shaft of an electric motor, which is the first driving means 6. Therefore, the shaft member 22*a* is rotated by the driving force of the first driving means 6, and when the cylindrical substrate 5 is mounted on the shaft members 22*a*, 22*b*, the cylindrical substrate 5 is rotated by the first driving means 6. An encoder that is the rotation number detecting means 10 is mounted on the output shaft of the first driving means 6 on the side opposite to the side on which the shaft member 22*a* is coupled. This rotation number detecting means 10 can detect the number of rotation of the first driving means 6, and thus the number of rotation of the cylindrical substrate 5. A rotation speed sensor that is the first circumferential speed detecting means 8 is mounted on the shaft member 22*a*, and this first circumferential speed detecting means 8 can detect the rotation speed of the first driving means 6, and thus the circumferential speed of the cylindrical substrate 5.

The applicator roll 2 is opposed to the cylindrical substrate 5 mounted on the shaft members 22*a*, 22*b*, and arranged such that an axis thereof is parallel to the axis of the cylindrical substrate 5. The applicator roll 2 is supported rotatably on the bearings (not shown) provided on the pair of second chocks 25*a*, 25*b* secured on the base stand 16 via a shaft 26 of the applicator roll 2. One end portion 27 of the shaft 26 of the applicator roll 2 is coupled to the output shaft of an electric motor that is the second driving means 7. Therefore, the applicator roll 2 is rotated by the driving force of the second driving means 7. Furthermore, a rotation speed sensor that is the second circumferential speed detecting means 9 is mounted on the shaft 26 of the applicator roll 2, and the second circumferential speed detecting means 9 can detect the rotation speed of the second driving means 7, and thus the circumferential speed of the applicator roll 2.

In this embodiment, in the application apparatus 1, the rotation direction (direction shown by the arrow 27) of the cylindrical substrate by the first driving means 6 is the same direction as the rotation direction (direction shown by the arrow 28) of the applicator roll 2 by the second driving means 7, and a small gap is formed between the outer circumference of the cylindrical substrate 5 and the outer circumference of the applicator roll 2. Thus, this apparatus is constituted by so-called reverse roll coating.

Supporting members 29*a*, 29*b* are provided in the second chocks 25*a*, 25*b* so as to be parallel to the surface of the base stand 16 and be rising outward, respectively. Air cylinders 30*a*, 30*b* are mounted on the supporting members 29*a*, 29*b* in the direction to the first chocks 21*a*, 21*b*. The edge portions of the rods of the air cylinders 30*a*, 30*b* are provided in first protrusion portion 31*a*, 31*b* formed in the first chocks 21*a*, 21*b* so as to be parallel to the surface of the base stand 16 and be rising outward. The air cylinders 30*a*, 30*b* are connected to a pneumatic unit 32 by a pipe (not shown), and the air supplied from the pneumatic unit 32 can move the rod forward and backward in directions shown by the arrow 23. This movement of the rods of the air cylinders 30*a*, 30*b* allows the first chocks 21*a*, 21*b* provided so as to be on a track to be close to or away from the fixed second chocks 25*a*, 25*b* in the direction shown by the arrow 23. That is to say, the cylindrical substrate 5 supported by the first chocks 21*a*, 21*b* moves so as to be close to or away from the applicator roll 2 supported by the second chocks 25*a*, 25*b*. The air cylinders 30*a*, 30*b*, the pipe and the pneumatic unit 32 constitute the detaching means 11.

In this embodiment, the coating liquid supplying means 4 is constituted by a pan in which the coating liquid 3 is stored in its internal space, and is provided on the base stand 16 such that the liquid surface of the coating liquid 3 stored in the pan is in contact with at least a part of the outer circumferential surface of the applicator roll 2. Thus, the rotating applicator roll 2 can be used for coating by applying the coating liquid 3 stored in the pan to its outer circumferential surface.

The application apparatus 1 of this embodiment further includes the film thickness adjusting means 15 for adjusting the thickness of a coating liquid 3 supplied to the applicator roll 2, as described above. For the cylindrical member 13 of the film thickness adjusting means 15, a metalling roll 13 is used in this embodiment. The metalling roll 13 is supported rotatably by a pair of third chocks 35*a*, 35*b* provided with respective bearings (not shown) via its shaft 34. The third chocks 35*a*, 35*b* are provided so as to be on a track (not shown) on the base stand 16 and can move in the directions shown by the arrow 23 by being guided by the track, as the first chocks 21*a*, 21*b*.

In the same manner as the first protrusion portions 31*a*, 31*b* formed in the first chocks 21*a*, 21*b*, the adjusting members 14 (14*a*, 14*b*) is constituted by each including a second protrusion portion 36*a*, 36*b* formed on the second chock 25*a*, 25*b*, a third protrusion portion 37*a*, 37*b* formed in the third chock 35*a*, 35*b* so as to be opposed to the second protrusion portion 36*a*, 36*b*, and a male screw member 38 provided between the second protrusion portion 36*a*, 36*b* and the third protrusion portions 37*a*, 37*b*. For example, the head portion of the male screw member 38 is mounted rotatably on the second protrusion portion 36*a*, 36*b*, and the threaded portion of the male screw is engaged in the female screw portion formed in the third protrusion portion 37*a*, 37*b*. By rotating the head portion of the male screw member 38, the rotation movement of the male screw member 38 is converted into straight movement of the third chock 35*a*, 35*b* in which the third protrusion portion 37*a*, 37*b* engaged in the male screw member 38 is formed and moves in the directions shown by the arrow 23. Thus, the third chock 35*a*, 35*b* moves so as to be close to or away from the second chock 25*a*, 25*b*. That is to say, the metalling roll 13 moves so as to be close to or away from the applicator roll 2, and the thickness of the coating liquid 3, which is the gap formed by the applicator roll 2 and the metalling roll 13, can be adjusted.

It should be noted that the adjusting member 14 is not limited to the configuration in which the male screw member 38 is used. The gap between the applicator roll 2 and the metalling roll 13 can be adjusted, for example, by providing an air cylinder or hydraulic cylinder between the second chock 25*a*, 25*b* and the third chock 35*a*, 35*b*, and operating the cylinder.

One end portion of the shaft 34 of the metalling roll 13 is coupled to the output shaft of an electric motor that is third driving means 39. The metalling roll 13 can be rotated by the driving force of the third driving means 39. Furthermore, a rotation speed sensor that is third circumferential speed detecting means 40 is mounted on the shaft 34 of the metalling roll 13, and the third circumferential speed detecting means 40 can detect the rotation speed of the third driving means 39, and thus the circumferential speed of the metalling roll 13.

The coating liquid 3 attached to the outer circumferential surface of the applicator roll 2 passes through the gap between the applicator roll 2 and the metalling roll 13, and the thickness of the coating liquid 3 is adjusted depending on the size of the gap when passing through this gap. The coating liquid 3 whose thickness has been adjusted is transferred from the applicator roll 2 to the cylindrical substrate 5. More specifically, the adjustment of the film thickness by the applicator roll 2 and the metalling roll 13 can be performed as follows. The film thickness of the coating liquid 3 can be adjusted (reduced in this case) by narrowing the gap between the two rolls or increasing the circumferential speed of the metalling roll 13 while rotating the applicator roll 2 and the metalling roll 13 in the directions shown by the arrows 28 and 45, respectively. The number of the metalling roll 13 is not limited to one, but two or more metalling rolls can be provided. Furthermore, the metalling roll can be used to adjust the film thickness by being rotated in the same direction or the opposite direction with respect to the adjacent roll or by being in the fixed position without being rotated.

In general, the thickness L of a dry coating film in the application apparatus 1 as shown in FIGS. 1 and 3 can be given as formula (1), and the thickness of the coating film can be adjusted based on formula (1).

$$L=K\alpha\eta g\cdot\sqrt{(R_m)}\cdot\sqrt{(R_t^3)}/R\gamma \quad (1)$$

where K; coefficient (coefficient specific to roll diameter)

α; solid concentration of the coating liquid (vol %),

γ: surface tension of the coating liquid,

η; viscosity in the shear rate during coating, g; gap size between the applicator roll and the metalling roll, $R_m$; circumferential speed of the metalling roll, $R_t$; circumferential speed of the applicator roll, and R; circumferential speed of the cylindrical substrate.

The application apparatus 1 is further provided with cleaning means 41 for the coating liquid 3. The cleaning means 41 scrapes the coating liquid 3 attached to the surface of the metalling roll 13 and collects the liquid in a pan that is the coating liquid supplying means 4. The cleaning means 41 includes a cleaning blade 42, fourth chocks 43*a*, 43*b* supporting the cleaning blade 42, and additional adjusting members 44*a*, 44*b*.

The fourth chocks 43*a*, 43*b* are provided on the base stand 16 and can move in the directions shown by the arrow 23 in the same manner as the first chocks 21*a*, 21*b*. The cleaning blade 42 is a plate-like member and provided such that the longitudinal direction thereof extends in the direction of the axis of the metalling roll 13, and scrapes the coating liquid 3 attached to the surface of the metalling roll 13, using its end portions in the short direction. The cleaning blade 42 is supported by the supporting portion of the fourth chocks 43*a*, 43*b* in such a manner that the angle can be changed. The size of the gap between the cleaning blade 42 and the metalling roll 13 is adjusted by changing the angle formed by its short direction and the metalling roll 13, so that the amount of the coating liquid 3 to be scraped can be adjusted. The additional adjusting members 44*a*, 44*b* can be adjusted to adjust the distance between the third chocks 35*a*, 35*b* and the fourth chocks 43*a*, 43*b*, that is, the size of the gap formed by the metalling roll 13 and the cleaning blade 42, in order to adjust the amount of the coating liquid 3 to be scraped. Furthermore, this adjustment can be used together with the angle change of the cleaning blade 42 as described above. The additional adjusting members 44*a*, 44*b* are configured in the same manner as the adjusting member 14 (14*a*, 14*b*) as described above, so that the description thereof is omitted.

Referring to FIG. 2, the electrical connection of the application apparatus 1 will be described below. The control means 12 is a processing circuit provided with a central processing unit (abbreviated as "CPU"). The control means 12 is provided with a memory 50, and the memory 50 stores programs for controlling the entire operation of the application apparatus 1 and application conditions that are predetermined in accordance with types and characteristics of a product to be produced by coating and the coating liquid 3 as table data.

The application conditions are a circumferential speed u1 of the cylindrical substrate 5 by the first driving means 6, a circumferential speed u2 of the applicator roll 2 by the second driving means 7, a circumferential speed u3 of the metalling roll 13 by the third driving means 39, a ratio r (=u1/u2) of the circumferential speed between the cylindrical substrate 5 and the applicator roll 2 when applying the cylindrical substrate 5 by using the applicator roll 2, a rotation speed of the cylindrical substrate 5 for determining the timing at which the cylindrical substrate 5 is detached from the applicator roll 2 after the start of coating, and a circumferential speed V1 of the cylindrical substrate 5, a circumferential speed V2 of the applicator roll 2, a ratio R (=V1/V2) of the circumferential speed between the cylindrical substrate 5 and the applicator roll 2 and a detachment rate by the detaching means 11 when detaching the cylindrical substrate 5 and the applicator roll 2 from each other.

The rotation number detecting means 10, the first circumferential speed detecting means 8, the second circumferential speed detecting means 9 and the third circumferential speed detecting means 40 are connected to the control means 12, and the number of rotation after the start of coating of the cylindrical substrate 5, the circumferential speed of the cylindrical substrate 5, the circumferential speed of the applicator roll 2 and the circumferential speed of the metalling roll 13, which are respective detection outputs, are input into the control means 12. The detaching means 11, the first driving means 6, the second driving means 7 and the third driving means 39 are also connected to the control means 12. The control means 12 controls the operations of the detaching means 11, the first driving means 6, the second driving means 7 and the third driving means 39 based on the control programs and the predetermined application conditions, in response to the detection outputs from the rotation number detecting means 10, the first circumferential speed detecting means 8, the second circumferential speed detecting means 9 and the third circumferential speed detecting means 40.

Hereinafter, a method for applying the coating liquid 3 to the cylindrical substrate 5 by the application apparatus 1 will be described. The coating liquid 3 is applied to cylindrical substrate 5 in the following manner: The thickness of the coating liquid 3 formed on the surface of the applicator roll 2 by the outer circumferential surface of the applicator roll 2 passing through the coating liquid 3 stored in the pan that is the coating liquid supplying means 4 is adjusted by the film thickness adjusting means 15. Then, the cylindrical substrate 5 is brought close to the applicator roll 2 so as to have a predetermined gap, and the coating film formed on the applicator roll 2 is transferred onto the cylindrical substrate 5 that is in contact with the coating film.

After the start of application, the cylindrical substrate 5 is rotated in such a manner that the number of rotation is in the range from 1 to 20 in order to make the thickness uniform. The rotation number is preferably 1.5 to 10, and more preferably 2 to 5. When the number of rotation of the cylindrical substrate 5 is less than 1, a uniform coating film cannot be obtained because the outer circumferential surface is partially not coated. When the number is more than 20, the operation takes a long time, which leads to poor production efficiency. Therefore, the rotation number is between 1 and 20.

The thickness of the coating liquid 3 to be transferred onto the cylindrical substrate 5 can be controlled by adjusting not only the size of the gap between the metalling roll 13 and the applicator roll 2 by the film thickness adjusting means 15 as described above, but also the circumferential speeds of the applicator roll 2 and the cylindrical substrate 5, the properties of the coating liquid 3, the material of the surface of the cylindrical substrate 5 and the applicator roll 2, the size of the gap between the cylindrical substrate 5 and the applicator roll 2 or the like.

It is preferable that the ratio r (=u1/u2) between the circumferential speed u1 of the cylindrical substrate 5 and the circumferential speed u2 of the applicator roll 2 at the time of applying a coating liquid to the cylindrical substrate 5 with the applicator roll 2, that is, at the time of transferring a coating film from the applicator roll 2 to the cylindrical substrate 5 is 0.7 to 1.4.

Hereinafter, the reason for the limitation of the range of the ratio r will be described. In general, the flow state of the coating liquid on the surface of the cylindrical substrate 5 differs with the ratio r between the circumferential speed u1 of the cylindrical substrate 5 and the circumferential speed u2 of the applicator roll 2. When the ratio r increases, a rib that causes the coating liquid to be continuously rough is formed, so that the thickness of the coating film becomes non-uniform. It is known that the lower limit of the generation of the rib is defined based on the relationship between the number of capillary Ca and the form parameter H0/D (H0: ½ of the gap between the cylindrical substrate 5 and the applicator roll 2, D: the radius of the cylindrical substrate 5), and eventually the lower limit is defined by the diameter of the roll, the size of the gap, the circumferential speed, the viscosity of the coating liquid, and the surface tension, which are factors influencing the number of capillary Ca and the form parameter H0/D. In order to form a coating film having a uniform thickness on the cylindrical substrate 5, it is important to prevent such a rib from being generated, and when the ratio r of the circumferential speed between the cylindrical substrate 5 and the applicator roll 2 is set to be in the range from 0.7 to 1.4, a uniform coating film can be formed without generating a rib under most conditions.

The largest feature in the application method of the invention is that the rotation number detecting means 10 detects that the number of rotation of the cylindrical substrate 5 after the start of application has reached the predetermined number, and at the same time, in response to the detection output thereof, the control means 12 controls the detaching means 11 so that the cylindrical substrate 5 is detached from the applicator roll 2, and also controls the operation of the first and the second driving means 6, 7 so that the circumferential speed V1 of the cylindrical substrate 5 is higher than the circumferential speed V2 of the applicator roll 2. In this case, it is preferable that the ratio R (=V1/V2) of the circumferential speed V1 of the cylindrical substrate 5 to the circumferential speed V2 of the applicator roll 2 is 1.2 to 15.0.

At the same time when the cylindrical substrate 5 is detached from the applicator roll 2, the circumferential speed of the one is higher than that of the other. Herein, since the size of the cylindrical substrate 5 is smaller than the size of the applicator roll 2, it is more advantageous to achieve higher speed of the cylindrical substrate 5 having a small size. Therefore, the circumferential speed V1 of the cylindrical substrate 5 is set to be higher than the circumferential speed V2 of the applicator roll 2.

The circumferential speed u1 of the cylindrical substrate 5 and the circumferential speed u2 of the applicator roll 2 in the state where the coating liquid is applied to the cylindrical substrate 5 by the applicator roll 2 can be the same as or different from the circumferential speed V1 of the cylindrical substrate 5 and the circumferential speed V2 of the applicator roll 2 that are set at the same time of detachment, respectively. For example, when coating is performed while the ratio r (=u1/u2) is set at 1.4, the circumferential speed of the cylindrical substrate 5 becomes higher than the circumferential speed of the applicator roll 2 simply by detaching the applicator roll 2 and the cylindrical substrate 5 from each other. However, in many cases, in the state of coating, the circumferential speed u1 of the cylindrical substrate 5 and the circumferential speed u2 of the applicator roll 2 are the same value, that is, the ratio r is set at 1.0, so that the circumferential speed of the applicator roll 2 is unchanged before and after detachment (u2=V2), and the circumferential speed of the cylindrical substrate 5 is made higher at the same time of detachment, so that the circumferential speed is controlled such that the circumferential speed V1 is higher than the circumferential speed u1.

In this embodiment, the ratio R of the circumferential speed is controlled as follows. At the same time when the rotation number detecting means 10 detects that the predetermined number has been reached, in response to the detection output, the control means 12 reads out table data corresponding to the application conditions stored in a memory 50, and outputs a rotation operation control signal to the first and the second driving means 6, 7 so that the circumferential speed V1 and V2 that are designated in the table data can be achieved.

The method for controlling the ratio R of the circumferential speed is not limited to the above, and for example, a method in which a load to the rotation axis of the cylindrical substrate is applied to reduce the circumferential speed, and the load is removed at the time of detachment to increase the circumferential speed of the cylindrical substrate; a method in which on the contrary, a load is applied to the applicator roll at the time of detachment to reduce the circumferential speed of the applicator roll so that the circumferential speed of the cylindrical substrate is relatively increased; or a method of changing the circumferential speed of the cylindrical substrate or the applicator roll by using a method in which as means for applying a load to the rotation axis, a friction member is provided at the rotation axis, and a brake is provided or a method in which the rotation axis is coupled with a clutch and the load is changed by the connection strength of the clutch.

When the circumferential speed V1 of the cylindrical substrate 5 and the circumferential speed V2 of the applicator roll 2 at the time of detaching the applicator roll 2 and the cylindrical substrate 5 from each other is the same, the coating film on the cylindrical substrate 5 and the coating film on the applicator roll 2 are stretched by the surface tension so that a connecting portion of the coating liquid is formed between the cylindrical substrate 5 and the applicator roll 2, although the two members are detached from each other. This connecting portion of the coating liquid is formed as if a bridge is formed between the cylindrical substrate 5 and the applicator roll 2, and therefore this is referred to as "bridging structure" for convenience herein.

In general, when the thickness is small, the concentration of the solvent in that portion is reduced fast, so that the surface tension in a portion having a small thickness is higher than in other portions. The thickness is small in the bridging structure portion as described above, so that the coating liquid flows from the coating film on the surface of the cylindrical substrate 5 and the applicator roll 2 to the bridging structure portion. Furthermore, when the cylindrical substrate 5 is further away from the applicator roll 2 and the bridging structure portion is cut, an edge is formed in the cut portion of the bridging structure portion, and the coating liquid flows in the edge portion and the amount of the coating liquid in the edge portion is increased. Thus, the edge portion in which the amount of the coating liquid is increased is not made uniform sufficiently, even if the cylindrical substrate is rotated for leveling, and thus a joint having a large thickness is formed.

On the other hand, when the circumferential speed V1 of the cylindrical substrate 5 is higher than the circumferential speed V2 of the applicator roll 2 at the time of detaching the cylindrical substrate 5 from the applicator roll 2, which is a feature of the invention, not only is a tension applied to the coating liquid for forming a coating film in the detachment direction, but also is shear force applied abruptly in the rotation direction, so that the coating liquid can be cut without forming the bridging structure. As a result, a joint of a coating film as described above is not formed, so that a coating film having a uniform thickness is formed on the surface of the cylindrical substrate 5. In particular, setting the ratio R (=V1/V2) of the circumferential speed between the cylindrical substrate 5 and the applicator roll 2 in the range from 1.2 to 15.0 ensures that generation of a joint is prevented. The range of the ratio R is preferably 1.3 to 8.0. When the ratio R of the circumferential speed is less than 1.2, the shear force is insufficient, so that the generation of a joint cannot be prevented sufficiently and a coating film having a uniform thickness cannot be obtained. When the ratio R of the circumferential speed exceeds 15.0, the extent of the increase of the speed before and after the detachment of the cylindrical substrate 5 is too large, so that a coating film swells in waves because of the acceleration and therefore a coating film having a uniform thickness cannot be obtained. Therefore, the ratio R of the circumferential speed is 1.2 to 15.0.

There is no particular limitation regarding the detachment rate of the applicator roll 2 and the cylindrical substrate 5 by the detaching means 11, but preferably it is set in the range from 5 mm/sec to 350 mm/sec. When the detaching speed is less than 5 mm/sec, the tension sufficient to act on the coating film may not be obtained. When the speed exceeds 350 mm/sec, the tension to act on the coating film is sufficient, but the coating film on the surface of the cylindrical substrate 5 swells in waves by the acceleration at the time of detachment, and thus a coating film having a uniform thickness may not be obtained.

The applicator roll 2 and the cylindrical substrate 5 are detached from each other, and then the coating films of the two members are cut without forming the bridging structure by the action of the shear force and the tension. Thereafter, it is preferable that the cylindrical substrate 5 remains rotated for a predetermined period to dry the coating film on the surface of the cylindrical substrate 5 to some extent. For example, when the solvent of the coating liquid applied onto the cylindrical substrate 5 has a high boiling point, the coating liquid 3 constituting the coating film has flowability even after the applicator roll 2 and the cylindrical substrate 5 are detached from each other after the coating liquid is applied onto the cylindrical substrate 5. Therefore, the coating film drops by the gravity effect so that a coating film having a uniform thickness may not be able to be formed. When a solvent having a relatively high volatility is used as the solvent, it is advantageous to provide a cover member for covering the entire application apparatus 1 in the portion of the applicator roll 2 and the cylindrical substrate 5 or on the base stand 16 to achieve a substantially airtight state in order to form a coating film having a uniform thickness.

Figure 4:
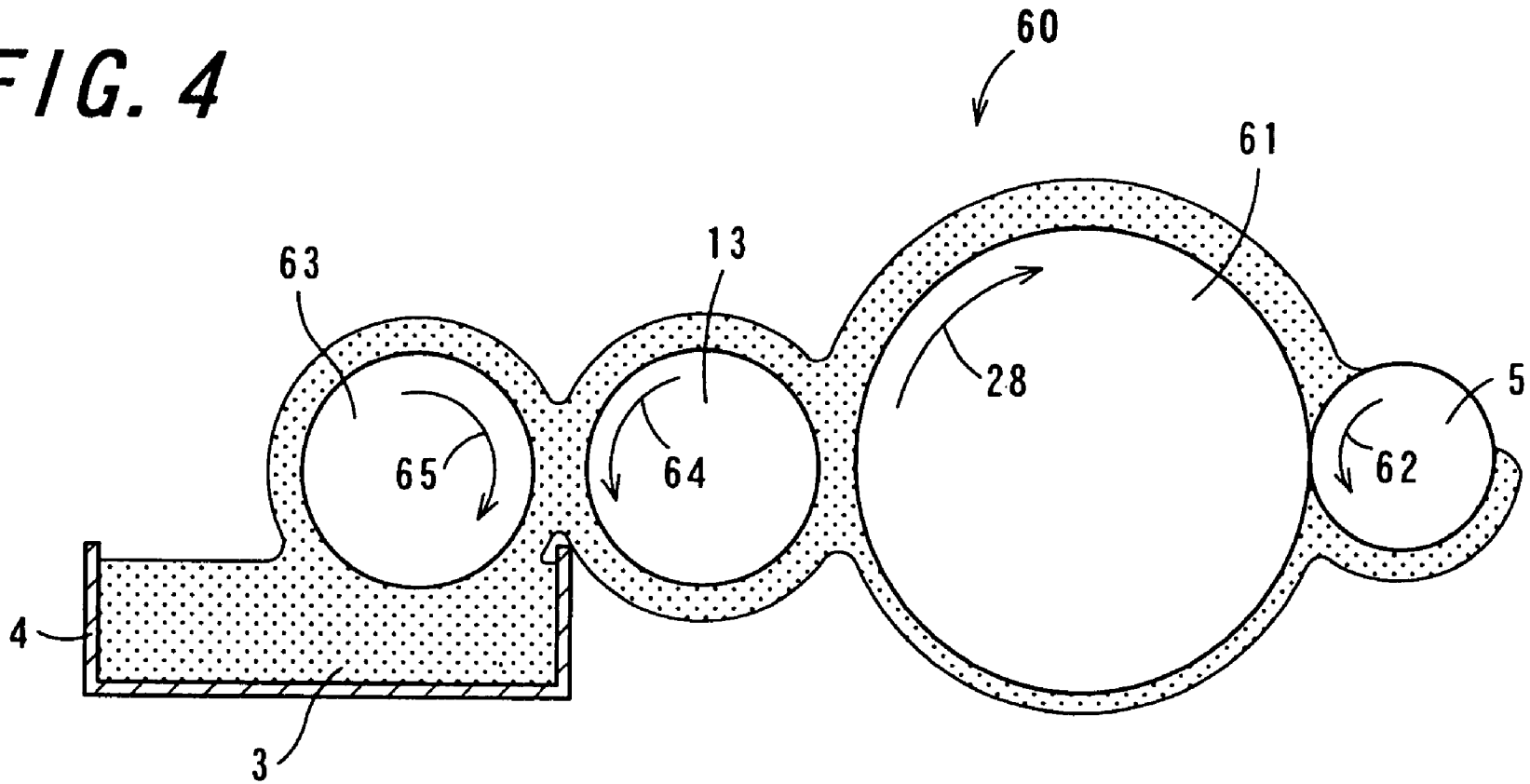
FIG. 4 is a cross-sectional view of a roll structure portion of an application apparatus according to a second embodiment of the invention.

FIG. 4 is a cross-sectional view of a roll structure portion of an application apparatus 60 according to a second embodiment of the invention. The application apparatus 60 of this embodiment is similar to the application apparatus 1 of the first embodiment, so that a plan view showing the configuration is omitted and the corresponding portion is denoted by the same reference numeral and the description thereof is omitted.

The application apparatus 60 of this embodiment is characterized in that an applicator roll 61 is formed of a material in which at least the surface layer has elasticity; the rotation direction (arrow 62) of the cylindrical substrate 5 by the first driving means 6 is opposite to the rotation direction (arrow 28) of the applicator roll 61 by the second driving means 7 while the coating liquid 3 is being transferred from the applicator roll 61 to the cylindrical substrate 5; and the cylindrical substrate 5 and the applicator roll 61 are arranged so as to come in contact with each other via the coating liquid 3, that is, arranged with a specific nip pressure. Thus, the application apparatus 60 of this embodiment is configured for natural roll coating in which the applicator roll 61 and the cylindrical substrate 5 are rotated in the opposite directions.

As an elastic material constituting at least the surface layer portion of the applicator roll 61, rubbers such as butyl rubber, ethylene propylene rubber and silicone rubber, organic polysulfide rubber, nitrilebutadiene rubber, nitrosulphonated polyethylene, and styrene butadiene rubber, resins such as silicone resins, fluororesin, and rubbers as described above coated with fluororesin can be used.

In the application apparatus 60, the cleaning means are eliminated, and another (second) metalling roll 63 is provided. The metalling roll 13 is rotated in the direction shown by the arrow 64, which is the direction opposite to that of the applicator roll 61 and the second metalling roll 63 is rotated in the direction shown by the arrow 65, which is the same direction as that of the applicator roll 61 and the direction opposite to that of the metalling roll 13. The gap between the applicator roll 61 and the metalling roll 13 and the gap between the two metalling rolls 13, 63 are adjusted to desired values by the adjusting members 14*a*, 14*b* and 44*a*, and 44*b*.

A structure different from that of the application apparatus 1 of the first embodiment is that a part of the second metalling roll 63 is immersed in the coating liquid 3 stored in the coating liquid supplying means 4. The coating liquid 3 attached to the second metalling roll 63 is supplied to the applicator roll 61 via the metalling roll 13, and applied and transferred from the applicator roll 61 to the cylindrical substrate 5. The thickness of the coating films is determined by mainly the gap size formed between the metalling rolls 13 and 63 and between the metalling roll 13 and the applicator roll 61, and other factors such as the properties of the coating liquid, the circumferential speed of each roll, the nip pressure, the material of the applicator roll 61 or the like.

In the case of natural roll coating, other than the setting the circumferential speed of the applicator roll 61 and the cylindrical substrate 5 at the time of detachment to be the circumferential speeds V1 and V2 by the operation control of the first and the second driving means 6, 7 as described above, the ratio R of the circumferential speed can be controlled in the following manner. For example, when the circumferential speed u1 of the cylindrical substrate 5 before detachment is set to be higher than the circumferential speed u2 of the applicator roll 61, the applicator roll 61 serves as a friction member, that is, a brake, with respect to the cylindrical substrate 5 by bringing the applicator roll 61 and the cylindrical substrate 5 in contact with each other by applying a nip pressure, because the surface layer of the applicator roll 61 is constituted by an elastic member. When the cylindrical substrate 5 is detached from the applicator roll 61 in this state, the brake effect, which is a frictional force, that has acted on the cylindrical substrate 5 is eliminated at the same time. Because the frictional force is eliminated, the cylindrical substrate 5 can be rotated at a higher circumferential speed than that of applicator roll 61. Thus, at the same time of detachment, the circumferential speed of the cylindrical substrate 5 can be changed immediately to be higher than the circumferential speed of the applicator roll 61.

Figure 5:
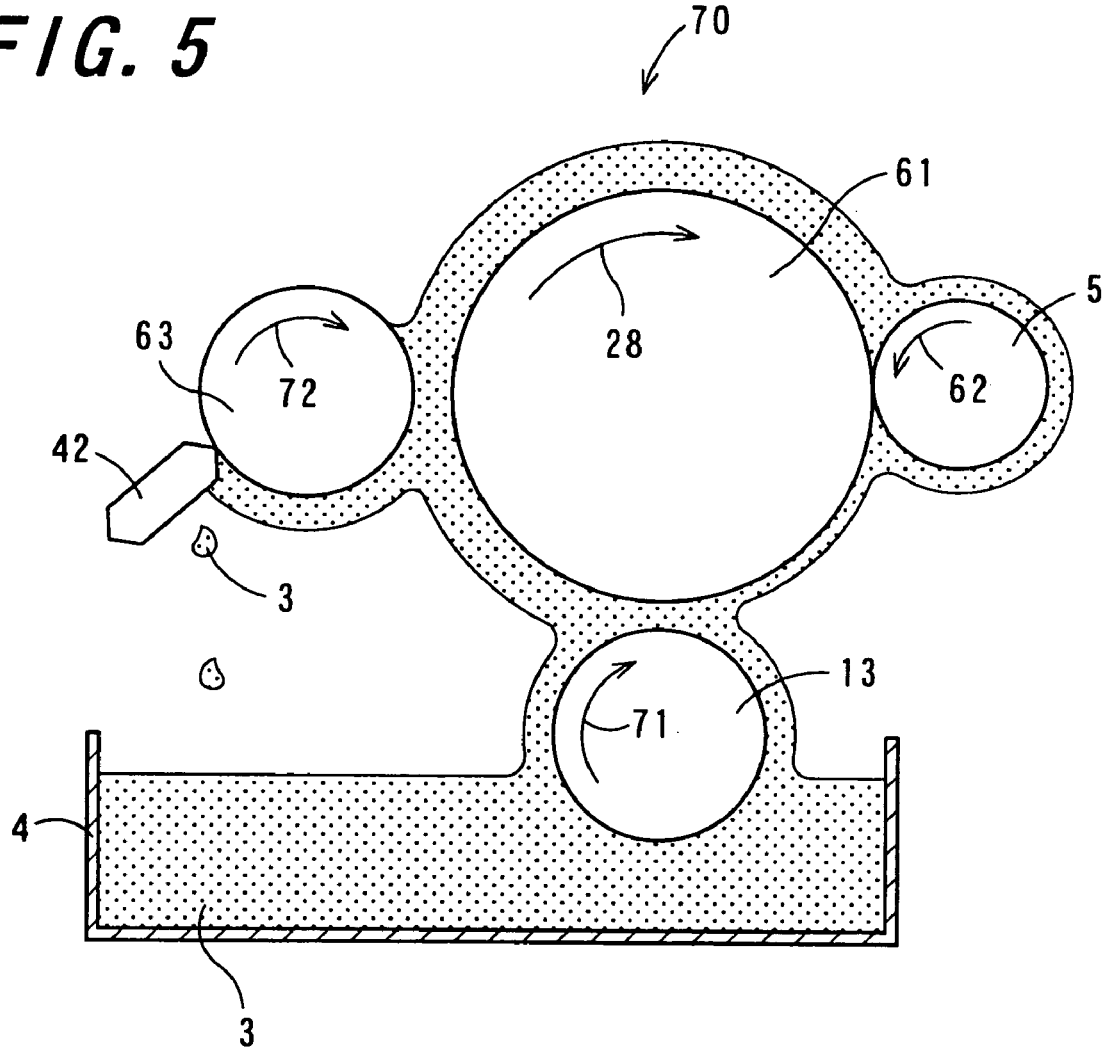
FIG. 5 is a cross-sectional view of a roll structure portion of an application apparatus according to a third embodiment of the invention.

In the application apparatus of the invention, various variations as shown below are acceptable. For example, FIG. 5 is a cross-sectional view of a roll structure portion of an application apparatus 70 according to a third embodiment of the invention. The application apparatus 70 of this embodiment is similar to the application apparatus 60 of natural roll coating system of the second embodiment, and the corresponding portion is denoted by the same reference numeral and the description thereof is omitted.

In the application apparatus 70, the metalling roll 13 is provided such that a part thereof is immersed in the coating liquid 3 stored in a pan that is coating liquid supplying means 4 and rotates in the direction shown by the arrow 71, and supplies the coating liquid 3 to the applicator roll 61 that is opposed to the metalling roll 13 and provided so as to have a predetermined gap above the metalling roll 13. The coating liquid 3 supplied to the applicator roll 61 is adjusted by the other (second) metalling roll 63 which is provided further downstream with respect to the metalling roll 13 in the rotation direction shown by the arrow 28 of the applicator roll 61. The coating liquid 3 whose thickness of the coating film is adjusted is transferred and applied to the cylindrical substrate 5 from the applicator roll 61. The application apparatus 70 is provided with cleaning means, and the coating liquid 3 on the surface of the second metalling roll 63 rotating in the direction shown by the arrow 72 is cleaned by a cleaning blade 42.

Figure 6:
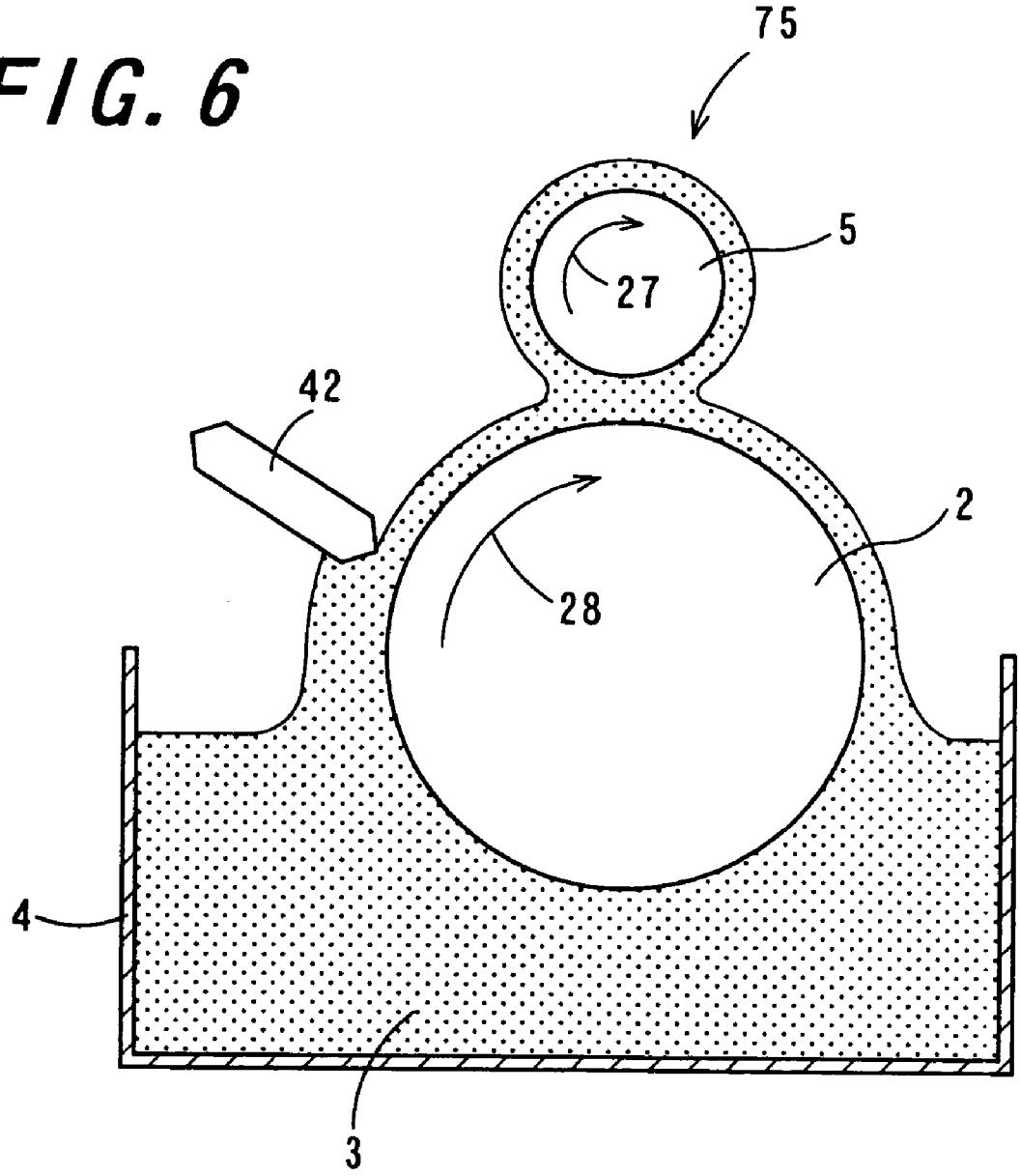
FIG. 6 is a cross-sectional view of a roll structure portion of an application apparatus according to a fourth embodiment of the invention.

FIG. 6 is a cross-sectional view of a roll structure portion of an application apparatus 75 according to a fourth embodiment of the invention. The application apparatus 75 of this embodiment is similar to the application apparatus 1 of the first embodiment, and the corresponding portion is denoted by the same reference numeral and the description thereof is omitted.

In the application apparatus 75, the cylindrical substrate 5 is opposed to the applicator roll 2 and provided above the applicator roll 2. Furthermore, the cylindrical substrate 5 is not provided with a metalling roll, and the cleaning means 41 serves also as film thickness adjusting means. The cleaning blade 42 of the cleaning means 41 is provided so as to have a predetermined gap with respect to the outer circumferential surface of the applicator roll 2. Thus, the cleaning blade 42 adjusts the film thickness on the surface of the applicator roll 2 and scrapes extra coating liquid 3 toward the pan. The application apparatus 75 of this embodiment is of a reverse roll coating system in which the applicator roll 2 and the cylindrical substrate 5 are rotated in the same direction, and the coating liquid 3 is applied with the applicator roll 2 and the cylindrical substrate 5 being arranged so as to have a gap therebetween.

The gas size between the applicator rolls 2, 61 and the metalling roll 13 or the cleaning blade 42 that is film thickness adjusting means can be set in the range from 1 μm to 1000 μm depending on the type of the coating liquid 3 applied, and the thickness of the film finally formed on the surface of the cylindrical substrate 5. It is preferable that the circumferential speed of the cylindrical substrate 5, the applicator rolls 2, 61 and the metalling roll 13 at the time of applying the coating liquid is selected in the range from 1 m/min to 600 m/min. When the circumferential speeds of the cylindrical substrate 5 and the applicator rolls 2, 61 are low, the coating film formed on the outer circumferential surface can be dried easily, and thus the uniformity of the film thickness is insufficient. On the other hand, when the circumferential speed is too high, the coating liquid may be scattered by the centrifugal force. The circumferential speed of the cylindrical substrate 5, the applicator rolls 2, 61 and the metalling roll 13 may be either the same or different.

The coating liquid supplying means is not limited to a method of storing the coating liquid 3 in a pan, but an inking device and a contact-type supplying device such as a sponge roll, or anon-contact type injection device such as a dispenser or a die nozzle may be used.

The method for applying a coating liquid to a cylindrical substrate of the invention is preferably used to produce an electrophotographic photoreceptor. An example of producing an electrophotographic photoreceptor will be described below. In the production of an electrophotographic photoreceptor, a cylindrical conductor support (original tube for electrophotographic photoreceptor) having conductivity is used as the cylindrical substrate, and a coating liquid for forming a photosensitive layer is used as the coating liquid.

The photosensitive layer of an electrophotographic photoreceptor herein may be of so-called a single layer type in which a charge-generating substance and a charge-transporting substance are contained in the same layer, or may be of a laminated type in which a charge-generating layer containing a charge-generating substance and a charge-transporting layer containing a charge-transporting substance are laminated. This layer does not necessarily consist of one layer, but two or more layers having different structures may be laminated to express the required characteristics.

Furthermore, an intermediate layer may be provided between the conductive support and the layers containing the charge-generating substance and a charge-transporting substance or a charge-generating layer and a charge-transporting layer (these layers are collectively referred to as "optical conductive layer" for convenience) constituting the laminated type. By forming the intermediate layer, charges are prevented from being injected from the conductive support to the optical conductive layer, so that deterioration in the charging characteristics of the electrophotographic photoreceptor can be prevented. According to the electrophotographic photoreceptor in which the intermediate layer is formed, a reduction of surface charges in portions other than the portion where charges are to be eliminated by exposure is suppressed and therefore defects such as a fog in the images can be prevented from being generated. Furthermore, the defects on the surface of the conductive support are covered by the intermediate layer, so that a uniform surface can be obtained, and therefore the formability of the optical conductive layer can be increased. Furthermore, peeling of the optical conductive layer from the conductive support is suppressed and the adhesiveness with respect to the conductive support can be improved.

Furthermore, a protective layer may be provided on the surface of the optical conductive layer. The printing resistance of the optical conductive layer can be improved, and chemical adverse effect of ozone or nitrogen oxide that are generated by corona discharge at the time of charging the surface of an electrophotographic photoreceptor can be prevented. In order to suppress non-uniformity of the conductivity of the conductive support, a coating film provided with conductivity such as carbon paste or silver paste may be formed on the conductive support. The electrophotographic photoreceptor of the invention is not limited to the layer structure as described above, but various layer structures can be used.

Hereinafter, the conductive support and the coating liquid will be described in detail.

As a material of the cylindrical conductive support (original tube for an electrophotographic photoreceptor), for example, metal materials such as aluminum, aluminum alloys, copper, zinc, stainless steel, and titanium can be used. The material is not limited to these metal materials, and polymer materials such as polyethylene terephthalate, polyester, polyoxymethylene and polystyrene, a metal foil laminated on the surface of hard paper or glass, a metal material evaporated on the same, or a layer of a conductive compound such as conductive polymer, tin oxide, indium oxide, carbon particles, and metal particles evaporated or applied on the same can be also used. The surface of the conductive support may be subjected to an anodic oxide coating treatment, a surface treatment with a pharmaceutical or hot water, a coloring treatment, or a diffused reflection treatment such as roughing the surface within the range that does not influence images, if necessary. In an electrophotographic process using a laser as an exposure light source, wavelengths of the laser are matched with each other, so that incident laser light and light reflected in the electrophotographic photoreceptor interferes with each other. Therefore, interference fringes due to the interference appear on images and thus image defects may occur. The image defects due to the interference of layer light having matched wavelengths can be prevented by subjecting the surface of the conductive support to a diffused reflection treatment as described above.

The charge-generating layer contains a charge-generating substance that generates charges by absorbing light as a main component. As an effective substance as the charge-generating substance, various organic pigments including azo pigments such as monoazo pigment, bisazo pigment, and trisazo pigment, indigo pigments such as indigo or thioindigo, perylene pigments such as perylene imide and perylene acid anhydride, polycyclic quinone pigments such as anthraquinone or pyrene quinone, phthalocyanine pigments such as metal phthalocyanine and metal-free phthalocyanine, triphenylmethane dyes such as methyl violet, crystal violet, night blue and victoria blue, acridine dyes such as erythrosine, rhodamine B, rhodamine 3R, acridine orange and frapeosine, thiazine dyes such as methylene blue and methylene green, oxazine dyes such as capri blue and meldola blue, squarylium dye, pyrylium salts and thiopyrylium salts, thioindigo dye, bisbenzoimidazole dye, quinacridone dye, quinoline dye, lake dye, azolake dye, dioxazine dye, azulenium dye, triallylmethane dye, xanthene dye and cyanine dye, coloring matters, and further inorganic materials such as amorphous silicon, amorphous selenium, tellurium, selenium-tellurium alloys, cadmium sulfide, antimony sulfide, zinc oxide and zinc sulfide can be used. These charge-generating substances can be used alone or in combination of two or more.

In order to form a charge-generating layer, a charge-generating substance can be vacuum-deposited on a conductive support, or a coating liquid for forming a charge-generating layer obtained by diffusing a charge-generating substance in a solvent can be applied onto a conductive support. Among these, a method of diffusing a charge-generating substance in a binder resin solution obtained by mixing a binder resin, which is a binding agent, in a solvent by a known method, and applying the obtained coating liquid onto a conductive support is preferable. Thereinafter, the application method will be described.

For the binder, one selected from the group consisting of resins such as polyester resin, polystyrene resin, polyurethane resin, phenol resin, alkyd resin, melamine resin, epoxy resin, silicone resin, acrylic resin, methacryl resin, polycarbonate resin, polyalylate resin, phenoxy resin, polyvinyl butyral resin and polyvinyl formal resin and a copolymer resin including two or more repetition units constituting these resins is used alone, or two or more selected from the above are mixed. Specific examples of copolymer resins include insulating resins such as vinyl chloride-vinyl acetate copolymer resin, vinyl chloride-vinyl acetate-maleic anhydride copolymer resin, and acrylonitrile-styrene copolymer resin. The binder resin is not limited to the above, but generally known resins can be used as the binder resin.

For the solvent, halogenated hydrocarbon such as tetrachloropropane or dichloroethane, ketones such as isophorone, methyl ethyl ketone, acetophenone, cyclohexanone, esters such as ethyl acetate, methyl benzoate, and butyl acetate, ethers such as tetrahydrofuran (THF), dioxane, dibenzyl ether, 1,2-dimethoxyethane or dioxane, glymes such as methyl carbitol or butylcarbitol, aromatic hydrocarbon such as benzene, toluene, xylene, mesitylene, tetralin, diphenylmethane, dimethoxybenzene, and dichlorobenzene, sulfur-containing solvents such as diphenylsulfide, fluorine-based solvents such as hexafluoroisopropanol, nonprotic polar solvents such as N,N-dimethylformamide or N,N-dimethylacetamide can be used. Furthermore, a mixed solvent obtained by mixing two or more of these solvents can be used.

The mixing ratio of the charge-generating substance and the binder resin is preferably in the range from 10 wt % to 99 wt %, taking the weight of the entire charge-generating layer as 100%. When the charge-generating substance is less than 10 wt %, the sensitivity is reduced. When the charge-generating substance is more than 99 wt %, not only is the film strength of the charge-generating layer reduced, but also is the dispersibility of the charge-generating substance reduced and the number of coarse particles is increased so that the surface charge in portions other than the portion where charges are to be eliminated by exposure is reduced. Therefore, many image defects, in particular, fog of images called "black dots" in which toner is attached in a white portion and small black spots are formed occurs.

The charge-generating substance may be pulverized in advance by a pulverizer as a pre-treatment prior to dispersing the charge-generating substance in a binder resin solution. As a pulverizer used for the pulverizing treatment, for example, a ball mill, a sand mill, an atoliter, a vibrating mill, and an ultrasonic disperser can be used.

When the charge-generating substance is dispersed in a binder resin solution, a disperser to be used, a paint shaker, a ball mill, a sandmill or the like can be used. As the dispersing conditions, it is preferable to select suitable conditions such that contamination of impurities is not caused by abrasion of the members constituting the container and the dispersing machine used.

Furthermore, if necessary, various additives such as a hole-transporting material, an electron-transporting material, an antioxidant, a dispersion stabilizer, and a sensitizing agent can be added to the charge-generating layer. Thus, the potential characteristics are improved, the stability as a coating liquid is enhanced, fatigue deterioration caused by using the electrophotographic photoreceptor repeatedly can be reduced, and the durability can be improved.

The charge-generating layer is formed by preparing a coating liquid for forming a charge-generating layer as described above and applying the prepared coating liquid by the application method of the invention. The thickness of the charge-generating layer is preferably 0.05 μm or more and 5 μm or less, more preferably 0.1 μm or more and 1 μm or less. When the thickness is less than 0.05 μm, the efficiency of light absorption is reduced, and the sensitivity is reduced. When the thickness of the charge-generating layer exceeds 5 μm, charge transfer in the internal portion of the charge-generating layer is in the rate-limiting step in the process of eliminating electric charges on the surface of the photoreceptor, and therefore the sensitivity is reduced.

The charge-transporting layer is obtained by allowing a charge-transporting substance having an ability of receiving and transporting electric charges generated in the charge-generating substance to be contained in a binder resin. As the charge-transporting substance, hole-transporting substances and electron-transporting substances can be used. As the hole-transporting substances, carbazole derivatives, pyrene derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, polycyclic aromatic compounds, indole derivatives, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, triarylmethane derivatives, phenylenediamine derivatives, stilbene derivatives, enamine derivatives, and benzidine derivatives can be used. Furthermore, a polymer having a group derived from these compounds in the principal chain or the side chain such as poly-N-vinylcarbazole, poly-1-vinylpyrene, ethyl carbazole-formaldehyde resin, triphenylmethane polymer, and poly-9-vinylanthracene, or polysilane can be used.

As the electron-transporting substance, for example, organic compounds such as benzoquinone derivatives, tetracyanoethylene derivatives, tetracyanoquinodimethane derivatives, fluorenone derivatives, xanthone derivatives, phenanthraquinone derivatives, phthalic anhydride derivatives, and diphenoquinone derivatives, inorganic materials such as amorphous silicon, amorphous selenium, tellurium, selenium-tellurium alloys, cadmium sulfide, antimony sulfide, zinc oxide and zinc sulfide can be used. The charge-transporting substance is not limited to those described above, and in use, these substances can be used alone or in combination of two or more.

For the binder resin of the charge-transporting layer, those having excellent compatibility with the charge-transporting substance are selected. Specific examples include resins such as polymethyl methacrylate resin, polystyrene resin, vinyl polymer resins such as polyvinyl chloride resin and copolymer resins thereof, polycarbonate resin, polyester resin, polyester carbonate resin, polysulfone resin, phenoxy resin, epoxy resin, silicone resin, polyalylate resin, polyamide resin, methacryl resin, acrylic resin, polyether resin, polyurethane resin, polyacrylamide resin, and phenol resin. Furthermore, thermosetting resins in which these resins are partially cross-linked can be used. These resins can be used alone or in combination of two or more. Among the above-described resins, polystyrene resin, polycarbonate resin, polyalylate resin, or polyphenylene oxide are particularly preferably used as the binder resin, because these resins have a volume resistance value of $10^{13}$ Ω or more and have excellent electrical insulation, and have excellent formability and potential characteristics.

The ratio (A/B) of the charge-transporting substance (A) and the binder resin (B) is 10/12 to 10/30 in weight ratio. When the ratio (A/B) is less than 10/30 and thus the ratio of the binder resin is high, sufficient responsibility cannot be obtained with the current charge-transporting ability of the charge-transporting substance. When the ratio (A/B) is more than 10/12 and thus the ratio of the binder resin is low, the printing resistance is lower in comparison with a case where the ratio of the binder resin is high, thereby the abrasion amount of the photosensitive layer is increased. Therefore, the ratio (A/B) is in a range between 10/12 and 10/30.

In order to improve the formability, flexibility and surface smoothness, if necessary, an additive such as plasticizer or surface modifier may be added to the charge-transporting layer. As the plasticizer, for example, biphenyl, chlorinated biphenyl, benzophenone, o-ter-phenyl, dibasic acid ester, fatty acid ester, phosphate ester, phthalate ester, various fluorohydrocarbons, chlorinated paraffin, or epoxy plasticizer can be used. As the surface modifier, silicone oil or fluororesin can be used.

In order to increase the mechanical strength and to improve the electrical characteristics, fine particles of an inorganic compound and an organic compound may be added to the charge-transporting layer. Furthermore, if necessary, various additives such as antioxidant and sensitizer may be added. Thus, the potential characteristics are improved and the stability as a coating liquid is enhanced, fatigue deterioration caused by using the electrophotographic photoreceptor repeatedly can be reduced, and the durability can be improved.

For the antioxidant, hindered phenol derivatives or hindered amine derivatives are preferably used. It is preferable that hindered phenol derivatives are used in the range from 0.1 wt % to 50 wt % with respect to the charge-transporting substance. It is preferable that hindered amine derivatives is used in the range from 0.1 wt % to 50 wt % with respect to the charge-transporting substance. The hindered phenol derivatives and the hindered amine derivatives may be mixed. In this case, it is preferable that the total amount of the hindered phenol derivatives used and hindered amine derivatives used is in the range from 0.1 wt % to 50 wt % with respect to the charge-transporting substance. When the amount of the hindered phenol derivatives used, the amount of the hindered amine derivatives used or the total amount of the hindered phenol derivatives used and hindered amine derivatives used is less than 0.1 wt % with respect to the charge-transporting substance, an adequate effect to improve the stability of the coating liquid and the improve the durability of the electrophotographic photoreceptor cannot be exhibited. When the amount exceeds 50 wt %, the characteristics of the electrophotographic photoreceptor is adversely affected.

The charge-transporting layer is formed by dissolving or dispersing the charge-transporting substance and the binder resin and if necessary, the additives in a suitable solvent to prepare a coating liquid for forming a charge-transporting layer, and applying this coating liquid on a charge-generating layer by an application method of the invention.

As the solvent used for the coating liquid, one selected from the group consisting of aromatic hydrocarbons such as benzene, toluene, xylene, mesitylene, tetraline, diphenylmethane, dimethoxybenzene and dichlorobenzene, halogenated hydrocarbons such as dichloromethane or dichloroethane, ethers such as THF, dioxane, dibenzyl ether, and dimethoxymethylether, ketones such as cyclohexanone, acetophenone, and isophorone, esters such as methyl benzoate, and ethyl acetate, sulfur-containing solvents such as diphenylsulfide, fluorine-based solvents such as hexafluoroisopropanol, nonprotic polar solvents such as N,N-dimethylformamide is used alone, or two or more of them are mixed. If necessary, a solvent such as alcohols, acetonitrile or methyl ethyl ketone further can be added to the above-described solvent.

The thickness of the charge-transporting layer is preferably 5 μm or more and 50 μm or less, more preferably 10 μm or more and 40 μm or less. When the thickness of the charge-transporting layer is less than 5 μm, the charge retention ability on the surface of the electrophotographic photoreceptor is reduced. When the thickness of the charge-transporting layer is more than 50 μm, the resolution of the electrophotographic photoreceptor is reduced. Therefore, the thickness is 5 μm or more and 50 μm or less.

In the case of a laminated photoreceptor, the charge-transporting layer may be laminated on the charge-generating layer. Alternatively, the charge-generating layer may be laminated on the charge-transporting layer. In the case of a single layer photoreceptor, a layer containing the charge-generating substance and the charge-transporting substance can be formed in the same manner as in the case of forming the charge-transporting layer as described above. For example, this layer can be formed by dissolving or dispersing the charge-generating substance, the hole-transporting substance, the electron-transporting substance, and the binder resin in a suitable solvent as described above so as to prepare a coating liquid for forming an optical conductive layer, and applying this coating liquid for forming an optical conductive layer by the application method of the invention. The thickness of the optical conductive layer of a single layer photoreceptor is preferably 5 μm or more and 100 μm or less, more preferably 10 μm or more and 50 μm or less. When the thickness of the optical conductive layer is less than 5 μm, the charge retention ability on the surface of the electrophotographic photoreceptor is reduced. When the thickness of the optical conductive layer is more than 100 μm, the productivity is reduced.

The electrophotographic photoreceptor may be provided with an intermediate layer between the conductive support and the optical conductive layer. When there is no intermediate layer between the conductive support and the optical conductive layer, electric charges are injected from the conductive support to the optical conductive layer, and the charging characteristics are deteriorated, and surface charges are reduced in portions other than the portion where they are to be eliminated by exposure, and defects such as fog may occur in images. In particular, when an image is formed using a reverse development process, toner image is formed in a portion where surface charges are reduced by exposure. Therefore, when surface charges are reduced by another factor than exposure, fog of images called "black dots" in which toner is attached in a white portion and small black spots are formed occurs, and thus significant deterioration of images occur. That is to say, the charging characteristics are reduced in a small region because of the defects of the conductive support or the optical conductive layer, and fog of images such as black dots occurs, which leads to significant image defects.

However, by forming the intermediate layer, charges are prevented from being injected from the conductive support to the optical conductive layer, so that deterioration in the charging characteristics of the optical conductive layer can be prevented, and reduction in surface charges can be suppressed in portions other than the portion where charges are to be eliminated by exposure and therefore defects such as a fog in the images can be prevented. Furthermore, by providing the intermediate layer, the defects on the surface of the conductive support are covered, so that a uniform surface can be obtained, and therefore the formability of the optical conductive layer can be increased. Furthermore, peeling of the optical conductive layer from the conductive support is suppressed and the adhesiveness with respect to the conductive support can be improved.

For the intermediate layer, a resin layer made of various resin materials or an almite layer are used. Examples of resin materials forming a resin layer include resins such as polyethylene resin, polypropylene resin, polystyrene resin, acrylic resin, vinyl chloride resin, polyvinyl acetate resin, polyurethane resin, epoxy resin, polyester resin, melamine resin, polycarbonate resin, polyester carbonate resin, polysulfone resin, phenoxy resin, polyalylate resin, silicone resin, polyvinyl butyral resin and polyamide resin, and copolymer resins containing two or more repetition units constituting these resins, casein, gelatin, polyvinyl alcohol, and ethyl cellulose.

The intermediate layer may contain metal oxide particles or the like. If these particles are contained, the volume resistance value of the intermediate layer is regulated, and injection of electric charges from the conductive support to the optical conductive layer is further suppressed, and the electrical characteristics of the electrophotographic photoreceptor can be maintained under various environments. Examples of metal oxide particles include particles of titanium oxide, aluminum oxide, aluminum hydroxide, antitoxin. When metal oxide particles are to be contained in the intermediate layer, for example, the intermediate layer can be formed by dispersing these particles in a resin solution in which the above-described resin is dissolved so as to prepare a coating liquid for forming an intermediate layer and applying this coating liquid onto the conductive support.

For the solvent of the resin solution, in addition to the above-described organic solvents, water, alcohols such as methanol, ethanol, butanol, glymes such as methyl carbitol and butyl carbitol can be used. Mixed solvents in which two or more of these solvents are mixed can be used.

As a method for dispersing the particles in a resin solution, a general method using a ball mill, a sand mill, an atoliter, a vibrating mill, or an ultrasonic disperser can be used.

Regarding the total content C of the resin and the metal oxide in the coating liquid for forming an intermediate layer with respect to the content D of a solvent used for the coating liquid for forming an intermediate layer, C/D is preferably 1/99 to 40/60 in weight ratio, more preferably 2/98 to 30/70. The ratio of the resin to the metal oxide (resin/metal oxide) is preferably 90/10 to 1/99 in weight ratio, more preferably 70/30 to 5/95.

The thickness of the intermediate layer is preferably 0.01 μm or more and 20 μm or less, more preferably 0.1 μm or more and 10 μm or less. When the thickness of the intermediate layer is less than 0.01 μm, the layer does not substantially serve as an intermediate layer, and a uniform surface as a result of covering detects on the conductive support cannot be obtained, and injection of electric charges from the conductive support to the optical conductive layer cannot be prevented, so that the charging characteristics of the optical conductive layer are deteriorated. A thickness of the intermediate layer of larger than 20 μm is not preferable, because it is difficult to form a uniform intermediate layer, and the sensitivity of the electrophotographic photoreceptor is reduced.

Furthermore, a protective layer may be provided as the outermost layer of the photosensitive layer. By providing a protective layer, the printing resistance of the photosensitive layer can be improved, and chemical adverse effect of ozone or nitrogen oxide that are generated by corona discharge at the time of charging the surface of the electrophotographic photoreceptor can be prevented. For the protective layer, a layer made of, for example, resin, inorganic filler-containing resin or inorganic oxide can be used.

As the resin used for the protective layer, resins such as ABS resin, ACS resin, olefin-vinyl monomer copolymer, chlorinated polyether, allyl resin, phenol resin, polyacetal, polyamide, polyamide imide, polyacrylate, polyallylsulfone, polybutylene, polybutylene terephthalate, polycarbonate, polyethersulfone, polyethylene, polyethylene terephtalate, polyimide, acrylic resin, polymethyl pentene, polypropylene, polyphenylene oxide, polysulfone, polystyrene, AS resin, butadiene-styrene copolymer, polyurethane, polyvinyl chloride, polyvinylidene chloride, or epoxy resin can be used.

To the protective layer, for the purpose of improving abrasion resistance, fluorocarbon resins such as polytetrafluoroethylene, silicone resin, and inorganic filler or organic filler having a high hardness added to these resins can be added. The average particle diameter of these filers is preferably 0.02 μm to 3 μm, more preferably 0.05 to 1 μm. When the average particle diameter is less than 0.02 μm, the abrasion resistance of the surface protective layer is weakened, and the life of the electrophotographic photoreceptor is shortened. When the average particle diameter is more than 3 μm, the light tends to be scattered by the protective layer, so that the resolution is reduced.

Specific examples of the filter that can be added to the protective layer includes titanium oxide, tin oxide, zinc oxide, zirconium oxide, indium oxide, silicon nitride, calcium oxide, barium sulfate, ITO, silica, colloidal silica, alumina, carbon black, fluororesin fine powder, polysiloxane resin fine powder, and high molecular weight charge-transporting material fine powder, and one selected from the above or a mixture of two or more can be used. The surface of these fillers may be treated with an inorganic substance or an organic substance for the purpose of improving the dispersibility and the surface properties. In general, as water-repelling treatment, treatment with a silane coupling agent, treatment with a fluorine-based silane coupling agent, treatment with higher fatty acid or treatment of copolymerization with high molecular weight material can be used. As treatment with an inorganic substance, treatment of the surface of a filler with alumina, zirconia, tin oxide, or silica can be used.

The filler is pulverized together with the binder resin and/or the charge-transporting material, and a dispersing solvent, or dispersed as it is, and applied as a protective layer. The content of the filler in the protective layer formed by application is 5 to 50 wt %, preferably 10 to 40 wt %. When the content is less than 5 wt %, the abrasion resistance is not sufficient, and when the content is more than 50 wt %, the transparency of the protective layer is lost and the sensitivity may be reduced.

Example of the dispersing solvent includes ketones such as methyl ethyl ketone, acetone, methyl isobutyl ketone and cyclohexanone, ethers such as dioxane, tetrahydrofuran and ethyl cellosolve, aromatic substances such as toluene and xylene, halogens such as chlorobenzene and dichloromethane, esters such as ethyl acetate and butyl acetate. In the case where a pulverization process is added, a ball mill, a sand mill, or a vibrating mill can be used.

For the purpose of transporting holes or electrons efficiently, a hole-transporting substance or an electron-transporting substance that is a charge-transporting substance as described above may be added. For the purpose of improving the charging characteristics, a phenolic compound, a hydroquinone compound, a hindered phenol compound, a hindered amine compound, or a compound in which hindered phenol and hindered amine are present in the same molecule can be added. Furthermore, a plasticizer and/or a leveling agent may be added. As the plasticizer, a plasticizer that is used as a general resin plasticizer such as dibutyl phthalate and dioctyl phthalate can be used, and a suitable amount thereof is about 0 to 30 wt % with respect to the binding resin. As the leveling agent, silicone oils such as dimethyl silicone oil and methylphenyl silicone oil, a polymer having a perfluoroalkyl group in its side chain or oligomer can be used, and a suitable amount thereof is about 0 to 1 wt % with respect to the binding resin.

Furthermore, in order to constitute the protective layer with a layer made of a curable resin, various crosslinking reaction that are known in the field of materials, for example, radical polymerization, ion polymerization, thermal polymerization, photopolymerization, or radiation polymerization can be used. In order to realize the cured protective layer having a low surface energy, a material having a silicone structure, a perfluoroalkyl structure, or a long chain alkyl structure may be crosslinked by a known method.

In order to also provide the protective layer with a charge-transporting function as described above, a substance having a charge-transporting function or a polymer type charge-transporting substance may be crosslinked. For example, a crosslinkable organopolysiloxane resin and a compound that can be bonded thereto and contains structural units having charge-transporting properties are mixed and cured to be turned into polysiloxane resin, so that excellent durability and electric characteristics can be realized.

The thickness of the protective layer is preferably 0.5 μm or more and 5 μm or less, more preferably 1 μm or more and 3 μm or less. When the thickness of the protective layer is smaller than 0.5 μm, the protective layer tends to be peeled at the interface with the optical conductive layer, which is a layer below, when being applied by external force such as the contact of a blade or a charging roller. This is believed to be because when the protective layer has a small thickness and is subjected to external force, the protective layer cannot resist it by itself and a force is applied constantly to the interface with the optical conductive layer, and if this application lasts a long time, the applied force tends to cause displacement at the interface. Furthermore, abrasion may cause the entire protective layer to be lost before the life of the electrophotographic photoreceptor. When the thickness of the protective layer is larger than 5 μm, carriers are diffused while moving in the protective layer, letters tends to be larger than desired, and the sensitivity is reduced and residual potential is increased by repetition.

Figure 7:
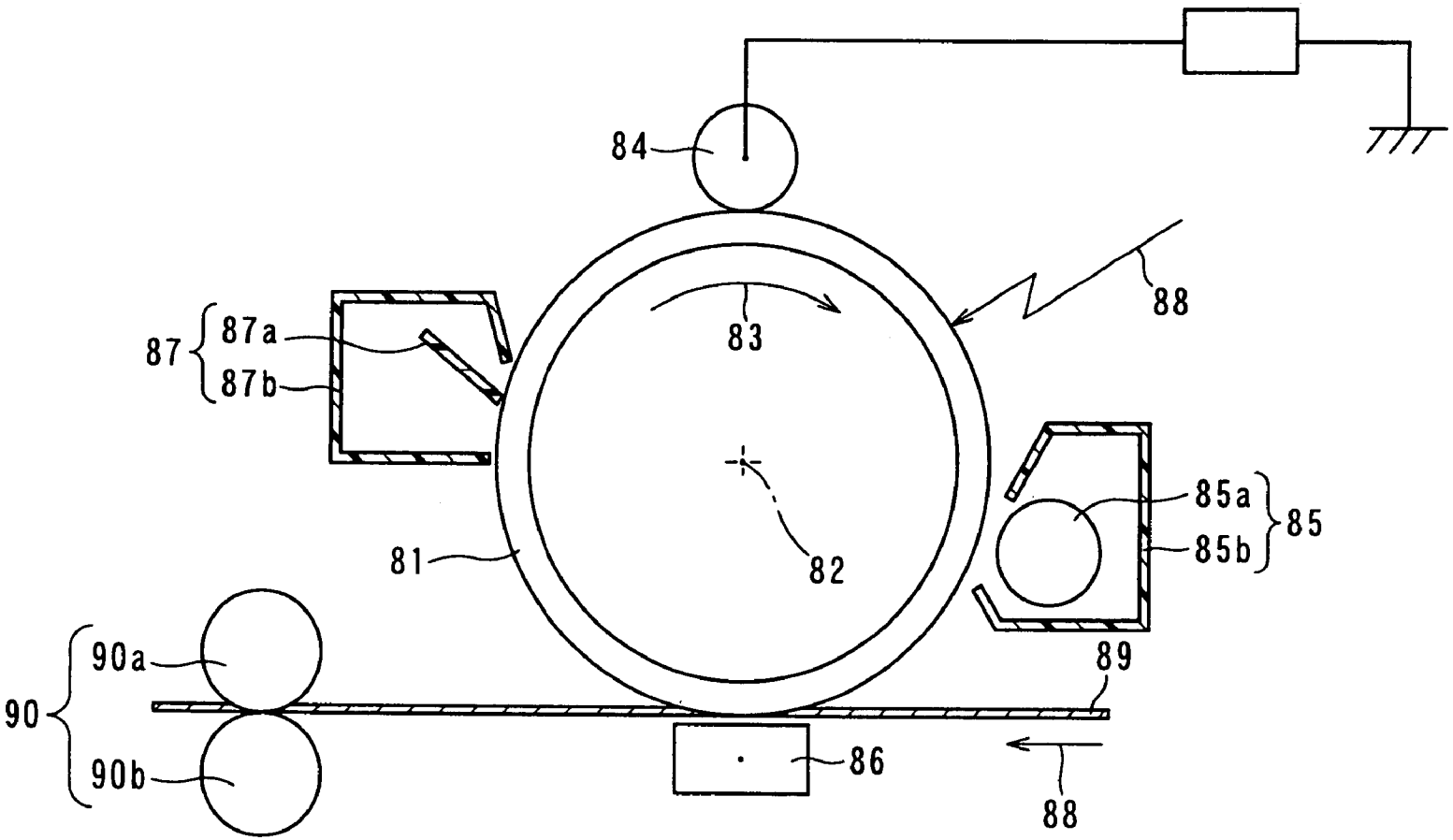
FIG. 7 is a side arrangement view schematically showing the configuration of an image forming apparatus according to another embodiment of the invention.

Next, FIG. 7 is a side arrangement view schematically showing the configuration of an image forming apparatus 80 according to another embodiment of the invention. The image forming apparatus 80 is characterized by including an electrophotographic photoreceptor produced by the application method of the invention. Referring to FIG. 7, the image forming apparatus 80 according to another embodiment of the invention will be described. The image forming apparatus of the invention is not limited by the description below.

The image forming apparatus 80 includes an electrophotographic photoreceptor 81 produced by the application method of the invention described above that is supported rotatably by a main body (not shown) of the apparatus, and driving means (not shown) for rotating the electrophotographic photoreceptor 81 around a rotation axis 82 in a direction shown by an arrow 83. The driving means includes for example, an electric motor and a reduction gear, and the driving force is transmitted to the conductive support constituting the core member of the electrophotographic photoreceptor 81, so that the electrophotographic photoreceptor 81 is rotated at a predetermined circumferential speed.

A charger 84, exposure means (not shown), a developing device 85, a transferring device 86, and a cleaner 87 are provided around the electrophotographic photoreceptor 81 in this order from the upstream to the downstream in the rotation direction of the electrophotographic photoreceptor 81 shown by the arrow 83. The cleaner 87 is provided together with a discharge lamp (not shown).

The charger 84 is charging means for charging an outer circumferential surface of the electrophotographic photoreceptor 81 at a predetermined potential. The charger 84 is realized by, for example, charging means of contact-type such as roller charging system.

The exposure means is provided with, for example, a semiconductor laser as a light source, performs exposure in accordance with image information with respect to the outer circumferential surface of the charged electrophotographic photoreceptor 81 by irradiating a portion between the charger 84 and the developing device 85 of the electrophotographic photoreceptor 81 with light 88 such as laser beams output from the light source. The light 88 is scanned repeatedly in the direction of the rotation axis 82 of the electrophotographic photoreceptor 81, which is the main scanning direction, and thus electrostatic latent images are formed sequentially on the surface of the electrophotographic photoreceptor 81.

The developing device 85 is developing means for developing the electrostatic latent images formed on the surface of the electrophotographic photoreceptor 81 by exposure with a developer. The developing device 85 includes a developing roller 85*a* and a casing 85*b*. The developing roller 85*a* is opposed to the electrophotographic photoreceptor 81 and supplies toner to the outer circumferential surface of the electrophotographic photoreceptor 81. The casing 85*b* supports the developing roller 85*a* rotatably around the rotation axis parallel to the rotation axis 82 of the electrophotographic photoreceptor 81 and contains the developer including toner in the internal space.

The transferring device 86 is transferring means for transferring toner images that are visible images formed on the outer circumferential surface of the electrophotographic photoreceptor 81 by development on a transfer sheet 89 that is a recording medium fed between the electrophotographic photoreceptor 81 and the transferring device 86 from the direction shown by an arrow 88 by conveying means (not shown) The transferring device 86 is transferring means of non-contact type that includes, for example, charging means and transfers toner images on the transfer sheet 89by providing charges having opposite polarity to that of toner to the transfer sheet 89.

The cleaner 87 is cleaning means for removing and collecting the toner remaining on the outer circumferential surface of the electrophotographic photoreceptor 81 after the transfer operation by the transferring device 86. The cleaner 87 includes a cleaning blade 87*a* for peeling the toner remaining on the outer circumferential surface of the electrophotographic photoreceptor 81, and a collection casing 87*b* for containing the toner peeled by the cleaning blade 87*a*.

Furthermore, the image forming apparatus 80 is provided with a fixing device 90 that is fixing means for fixing a transferred image in the downstream in a path in which the transfer sheet 89 having passed between the electrophotographic photoreceptor 81 and the transferring device 86 is conveyed. The fixing device 90 includes a heating roller 90*a* having heating means (not shown), and a pressing roller 90*b* that is opposed to the heating roller 90*a* and forms a contact portion by being pressed against the heating roller 90*a*.

The image forming operation by this image forming apparatus 80 is performed in the following manner. First, the electrophotographic photoreceptor 81 is rotated by the driving means in the direction shown by the arrow 83, and then the surface of the electrophotographic photoreceptor 81 is charged uniformly to a positive or negative potential as predetermined by the charger 84 provided further upstream in the rotation direction of the electrophotographic photoreceptor 81 than the image point of the light 88 from the exposure means.

Then, the surface of the electrophotographic photoreceptor 81 is irradiated with the light 88 in accordance with image information from the exposure means. In the electrophotographic photoreceptor 81, the surface charges in a portion irradiated with the light 88 are removed by this exposure, and a difference between the surface potential in the portion irradiated with the light 88 and the surface potential in the portion that is not irradiated with the light 88 is caused and thus electrostatic latent images are formed on its surface.

Then, toner is supplied from the developing device 85 provided further downstream in the rotation direction of the electrophotographic photoreceptor 81 than the image point of the light 88 from the light source to the surface of the electrophotographic photoreceptor 81 on which the electrostatic latent images are formed, so that the electrostatic latent images are developed, and thus toner images are formed.

In synchronization with the exposure of the electrophotographic photoreceptor 81, the transfer sheet 89 is supplied between the electrophotographic photoreceptor 81 and the transferring device 86. The supplied transfer sheet 89 is supplied with charges having a polarity opposite to the toner by the transferring device 86, and the toner images formed on the surface of the electrophotographic photoreceptor 81 are transferred onto the transfer sheet 89.

The transfer sheet 89 on which the toner images are transferred is conveyed to the fixing device 90 by the conveying means, and heated and pressed when passing through the contact portion between the heating roller 90*a* and the pressing roller 90*b* of the fixing device 90. Thus, the toner images are fixed to the transfer sheet 89 and become solid images. The transfer sheet 89 on which the images are formed is fed outside of the image forming apparatus 80 by the conveying means.

On the other hand, the toner remaining on the surface of the electrophotographic photoreceptor 81 after the toner images are transferred by the transferring device 86 is peeled from the surface of the electrophotographic photoreceptor 81 and collected by the cleaner 87. Thus, the charges on the surface of the electrophotographic photoreceptor 81 from which the toner is removed are removed by light from a discharge lamp so that electrostatic latent images on the surface of the electrophotographic photoreceptor 81 disappear. Thereafter, the electrophotographic photoreceptor 81 is further rotated and a series of operations starting from charging are repeated again and images are continuously formed.

The electrophotographic photoreceptor 81 provided in the image forming apparatus 80 is produced by the application method as described above, so that a photosensitive layer having a uniform thickness without a joint is formed. The photosensitive layer of the electrophotographic photoreceptor 81 is uniform, so that when electrostatic latent images are formed by exposure of the photosensitive layer and when a developer is supplied to the electrostatic latent images so as to form toner images, generation of image defects is prevented. Thus, an image forming apparatus 80 that does not generate image defects can be realized by providing the electrophotographic photoreceptor 81 produced by the application method of the invention.

EXAMPLES

Hereinafter, examples of the invention will be described, but the invention is not limited thereto.

Test 1

In test 1, a cylindrical conductive support made of aluminum having a diameter of 30 mm and a length of 340 mm was prepared, and an intermediate layer and a charge-generating layer were laminated on the surface of the conductive support by immersion coating, and further a charge-transporting layer was formed as the outer layer of the charge-generating layer. In forming the charge-transporting layer, an electrophotographic photoreceptor of Example 1 of the application method of the invention and electrophotographic photoreceptors of Comparative Examples 1 to 5 by application methods departing from the method of the invention were produced, and the uniformity of the thickness of the coating film of the charge-transporting layer was evaluated.

Example 1

A coating liquid for forming an intermediate layer was prepared by adding 9 parts by weight of dendritic titanium oxide (manufactured by ISHIHARA SANGYO Co., Ltd.: TTO-D-1) whose surface had been treated with aluminum oxide ($Al_2O_3$) and zirconium dioxide ($ZrO_2$) and 9 parts by weight of copolymer nylon resin (manufactured by Toray Industries, Inc.:CM8000) to a mixed solvent of 41 parts by weight of 1,3-dioxolane and 41 parts by weight of methanol, and then dispersing the mixture for 8 hours by using a paint shaker. This coating liquid for forming an intermediate layer was filled in a coating bath, and a conductive support was immersed in the coating bath and lifted therefrom, so that an intermediate layer having a thickness of 1.0 μm was formed on the conductive support.

Then, 2 parts by weight of oxotitanium phthalocyanine having a crystal structure showing a definite diffraction peak at least at a Bragg angle (2θ±0.2°) of 27.2° in the X-ray diffraction spectrum by Cu—Kα characteristic X-ray (wavelength: 1.54 Å) as oxotitanium phthalocyanine, which is a charge-generating substance, 1 part by weight of polyvinyl butyral resin (manufactured by Sekisui Chemical Co., Ltd.: S-LEC BM-S), and 97 parts by weight of methyl ethyl ketone were mixed, and the mixture was subjected to a dispersion treatment with a paint shaker, so that a coating liquid for forming a charge-generating layer was prepared. This coating liquid for forming a charge-generating layer was applied onto the previously formed intermediate layer in the same immersion coating as the previously formed intermediate layer, so that a charge-generating layer having a thickness of 0.4 μm was formed on the intermediate layer.

Furthermore, 10 parts by weight of triphenylamine dimmer (abbreviated as TPD) shown by structural formula (I), which is a charge-transporting substance, 16 parts by weight of polycarbonate resin (manufactured by Mitsubishi Engineering-Plastics Corporation: Iupilone Z300), which was a binder resin, 1 part by weight of 2,6-di-t-butyl-4-methyl phenol and 0.008parts by weight of diphenyl polysiloxane (manufactured by Shin-Etsu Chemical Co., Ltd.:KF-50) were dissolved in 104 parts by weight of xylene so that a coating liquid for forming a charge-transporting layer was prepared.

This coating liquid for forming a charge-transporting layer was applied onto the previously formed charge-generating layer by the application method of the invention using the application apparatus 60 of a natural roll coating system shown in FIG. 4. The circumferential speeds of the applicator roll 61, the metalling rolls 13, 63 and the conductive support 5 while transferring and applying the coating liquid on the conductive support were all 10 m/min. The gap between the metalling roll 13 and the second metalling roll 63 was 170 μm, and the gap between the metalling roll 13 and the applicator roll 61 was 100 μm.

First, the coating liquid for forming a charge-transporting layer was supplied from the coating liquid supplying means 4 to the outer circumferential surface of the metalling roll 63, and a coating film having a uniform thickness was formed with the two metalling rolls 13, 63 while rotating all of the rolls 61, 13, 63 and the conductive support 5. Thereafter, the metalling roll 13 is brought close until the above-described gap size is reached while rotating the applicator roll 61 and the coating film on the surface of the metalling roll 13 was transferred onto the applicator roll 61. Then, the conductive support 5 on which the intermediate layer and the charge-generating layer were formed as above described was brought in contact with the applicator roll 61 while being rotated, and thus application was started.

After the start of application, when the number of rotations of the conductive support reached a predetermined number of 2, the conductive support 5 was detached from the applicator roll 61 at a detachment rate of 50 mm/sec. The circumferential speed of the conductive support 5 was increased from 10 m/min to 18 m/min at the same time of the detachment. The circumferential speed of the applicator roll 61 was unchanged at 10 m/min before and after the detachment. Therefore, the ratio R (=V1/V2) of the circumferential speed between the circumferential speed V1 of the conductive support 5 and the circumferential speed V2 of the applicator roll 61 at the time of detachment was adjusted to be 1.8. The conductive support 5 remained rotated for 20 seconds in the state where the applicator roll 61 was away from the conductive support 5. Thereafter, drying was performed at 120° C. for one hour, so that a charge-transporting layer having a thickness of 23 μm was formed. In this manner, an electrophotographic photoreceptor of Example 1 was produced.

(1)

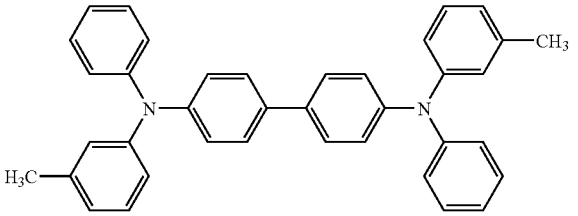

Comparative Example 1

An electrophotographic photoreceptor of Comparative Example 1 was produced in the same manner as in Example 1 except that the circumferential speed V1 of the conductive support at the time of detaching the applicator roll and the conductive support from each other was 10 m/min, which was the same as the circumferential speed during application, that is, the ratio R (=V1/V2) of the circumferential speed was 1.0.

Comparative Example 2

It was attempted to produce an electrophotographic photoreceptor of Comparative Example 2 in the same manner as in Example 1 except that the circumferential speed V1 of the conductive support at the time of detaching the applicator roll and the conductive support from each other was 160 m/min, that is, the ratio R of the circumferential speed was 16.0. However, since the circumferential speed of the conductive support at the time of detachment was too high, the coating liquid was scattered from the surface of the conductive support and the obtained electrophotographic photoreceptor was not usable as an electrophotographic photoreceptor.

Comparative Example 3

An electrophotographic photoreceptor of Comparative Example 3 was produced in the same manner as in Example 1 except that the gap between the applicator roll and the conductive support was 80 μm, an application apparatus of a reverse roll coating system that rotates the applicator roll and the conductive support in the same direction was used, the circumferential speed V1 of the conductive support at the time of detaching the conductive support was 10 m/min, that is, the ratio R of the circumferential speed was 1.0, the gap between the metalling roll and the applicator roll was 10 μm at 1.5 seconds after the start of coating, and further 0.5 seconds later, the conductive support was detached from the applicator roll.

Comparative Example 4

An electrophotographic photoreceptor of Comparative Example 4 was produced in the same manner as in Example 1 except that the gap between the applicator roll and the conductive support was 80 μm, an application apparatus of a reverse roll coating system that rotates the applicator roll and the conductive support in the same direction was used, the circumferential speed V1 of the conductive support at the time of detaching the conductive support was 10 m/min, that is, the ratio R of the circumferential speed was 1.0 and the conductive support was detached from the applicator roll at a detachment rate of 85 mm/sec.

Comparative Example 5

An electrophotographic photoreceptor of Comparative Example 5 was produced in the same manner as in Example 1 except that the gap between the applicator roll and the conductive support was 80 μm, an application apparatus of a reverse roll coating system that rotates the applicator roll and the conductive support in the same direction was used, the circumferential speed u1 of the conductive support at the time of coating was 25 m/min, that is, the ratio r (=u1/u2) of the circumferential speed was 2.5, and the circumferential speed V1 of the conductive support at the time of detaching the conductive support from the applicator roll was also 25 m/min, that is, the ratio R of the circumferential speed was also 2.5. In the electrophotographic photoreceptor of Comparative Example 5, a rib was generated during application of the coating liquid for forming a charge-transporting layer on the conductive support.

Evaluation of Test 1

The film thickness distributions in the axis direction and the circumferential direction of each electrophotographic photoreceptor produced in Example 1 and Comparative Examples 1, 3 to 5 were measured by multifunctional multichannel spectrophotometer (manufactured by Otsuka Electronics Co., Ltd.:MCPD2000).

Figure 8:
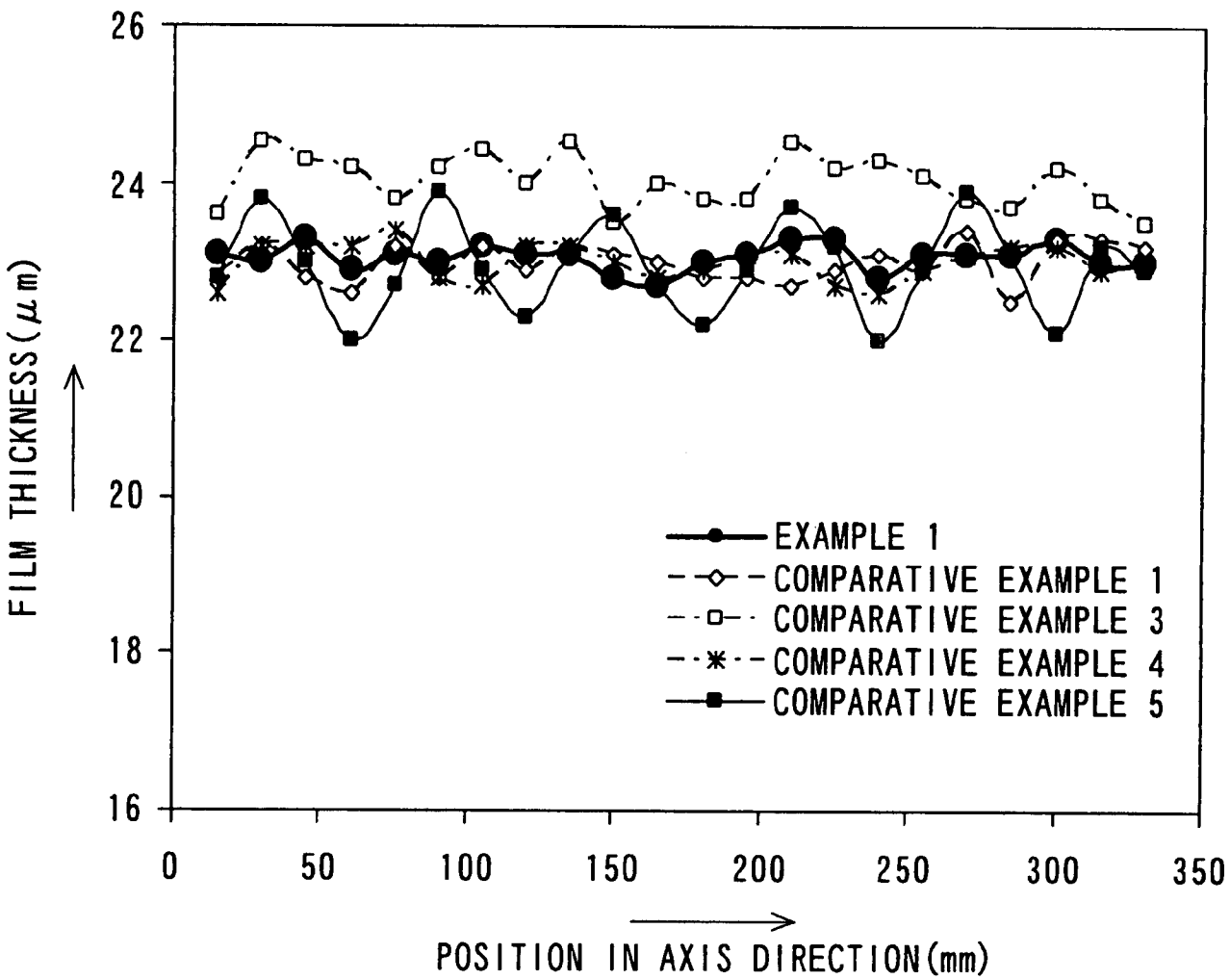
FIG. 8 is a graph showing results of measurement of film thickness in an axis direction.
Figure 9:
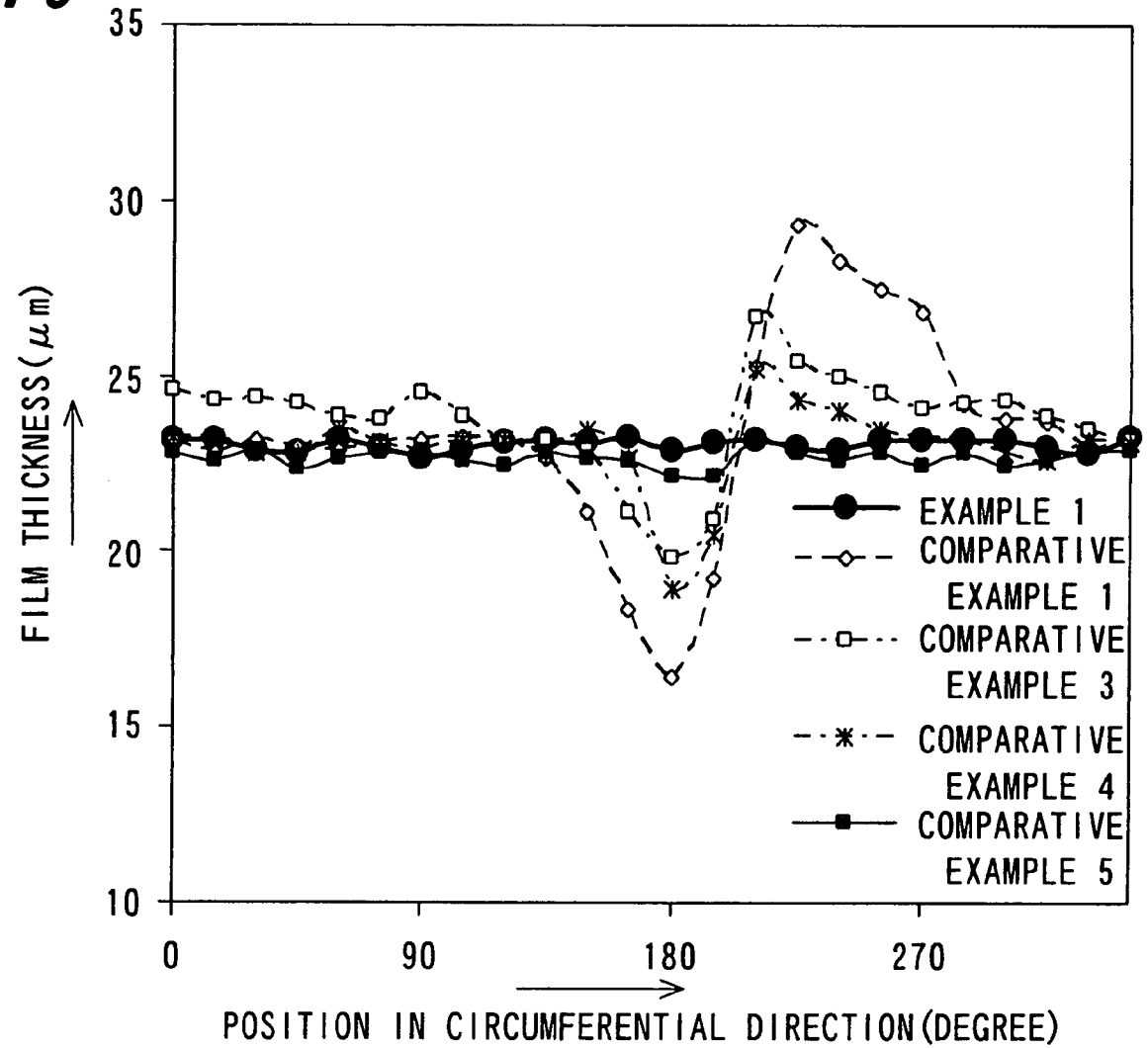
FIG. 9 is a graph showing results of measurement of film thickness in a circumferential direction.

FIGS. 8 and 9 show the measurement results. FIG. 8 is a graph showing the results of measurement of film thickness in the axis direction and FIG. 9 is a graph showing the results of measurement of film thickness in the circumferential direction. The film thickness distribution in the axis direction was substantially constant in all the electrophotographic photoreceptors except Comparative Example 5. In the film thickness distribution in the circumferential direction, when a method of detachment at a ratio of the circumferential speed of R=1.0 as in Comparative Example 1 was performed, a joint that causes a film thickness distribution having a large variation was generated. In Comparative Examples 3 and 4 of reverse roll coating system, which have a ratio R of the circumferential speed of 1.0 as in Comparative Example 1, although a joint was slightly improved, the electrophotographic photoreceptor was not usable in practice. In Comparative Example 5, which has a ratio R of the circumferential speed of 2.5, although a joint was substantially improved, regular change in film thickness due to the rib in the axis direction was observed because the ratio r of the circumferential speed was as large as 2.5. On the other hand, in the application method of the invention of Example 1, an electrophotographic photoreceptor in which there was no joint, and the film thickness distribution in the axis direction was substantially constant was obtained.

Test 2

In test 2, the same conductive support as in Test 1 was prepared, and an intermediate layer, a charge-generating layer, a charge-transporting layer and a protective layer were formed in a laminated type. In forming each layer, intermediate products or electrophotographic photoreceptors of Examples 2 to 5 of the application method of the invention and Comparative Examples 6 to 14 by application methods departing from the method of the invention were produced, and the uniformity of the thickness of the coating film of each layer was evaluated.

Example 2

A coating liquid for forming an intermediate layer was prepared by adding 10 parts by weight of dendritic titanium oxide (manufactured by ISHIHARA SANGYO Co., Ltd.: TTO-D-1) whose surface had been treated with aluminum oxide (chemical formula: $Al_2O_3$) and zirconium dioxide (chemical formula: $ZrO_2$) and 10 parts by weight of copolymer nylon resin (manufactured by Toray Industries, Inc.: CM8000) to a mixed solvent of 42 parts by weight of ethanol, 18 parts by weight of butyl carbitol and 30 parts by weight of benzyl alcohol, and then dispersing the mixture for 12 hours by using a paint shaker.

This coating liquid for forming an intermediate layer was applied onto the conductive support by the application method of the invention using the application apparatus 60 of a natural roll coating system shown in FIG. 4. The circumferential speeds of the applicator roll 61, the metalling rolls 13, 63 and the conductive support 5 while transferring and applying the coating liquid on the conductive support were all 6 m/min. The gap between the metalling roll 13 and the second metalling roll 63 was 80 μm, and the gap between the metalling roll 13 and the applicator roll 61 was 40 μm.

First, application was started in the same manner as in Example 1 as described above while rotating all of the rolls 61, 13, 63 and the conductive support 5. After the start of application, when the number of rotations of the conductive support 5 reached 2, the conductive support 5 was detached from the applicator roll 61 at a detachment rate of 50 mm/sec. The circumferential speed of the conductive support 5 was increased from 6 m/min to 9 m/min at the same time of the detachment. The circumferential speed of the applicator roll 61 was unchanged at 6 m/min before and after the detachment. Therefore, the ratio R (=V1/V2) of the circumferential speed between the circumferential speed V1 of the conductive support 5 and the circumferential speed V2 of the applicator roll 61 at the time of detachment was adjusted to be 1.5. The conductive support 5 remained rotated for 20 seconds in the state where the applicator roll 61 was away from the cylindrical substrate 5. Thereafter, drying was performed at 120° C. for one hour, so that an intermediate layer coating film was formed. In this manner, an intermediate product of an electrophotographic photoreceptor of Example 2 in which the intermediate layer coating film was formed was produced.

Comparative Example 6

An intermediate product of an electrophotographic photoreceptor of Comparative Example 6 in which the intermediate layer coating film was formed was produced in the same manner as in Example 2 except that the circumferential speed V1 of the conductive support at the time of detaching the applicator roll and the conductive support from each other was 6 m/min, which was the same as the circumferential speed during application, that is, the ratio R of the circumferential speed was 1.0.

Example 3

First, 4 parts by weight of oxotitanium phthalocyanine having a crystal structure showing a definite diffraction peak at least at a Bragg angle (2θ±0.2°) of 27.2° in the X-ray diffraction spectrum by Cu—Kα characteristic X-ray (wavelength: 1.54 Å) as oxotitanium phthalocyanine, which is a charge-generating substance, 4 parts by weight of polyvinyl butyral resin (manufactured by Sekisui Chemical Co., Ltd.: S-LEC BM-S), and 92 parts by weight of cyclohexanone were mixed, and the mixture was subjected to a dispersion treatment for 10 hours by a paint shaker, so that a coating liquid for forming a charge-generating layer was prepared.

This coating liquid for forming a charge-generating layer was applied onto the intermediate layer previously formed in Example 2 by the application method of the invention using the same application apparatus 60 as in Example 2. The circumferential speeds of the applicator roll 61, the metalling rolls 13, 63 and the conductive support 5 while transferring and applying the coating liquid on the intermediate layer of the conductive support were 4 m/min. The gap between the metalling roll 13 and the second metalling roll 63 was 60 μm, and the gap between the metalling roll 13 and the applicator roll 61 was 30 μm.

First, application was started in the same manner as in Example 2 while rotating all of the rolls 61, 13, 63 and the conductive support 5. After the start of application, when the number of rotations of the conductive support 5 reached 2, the conductive support 5 was detached from the applicator roll 61 at a detachment rate of 50 mm/sec. The circumferential speed of the conductive support 5 was increased from 4 m/min to 6 m/min at the same time of the detachment. The circumferential speed of the applicator roll 61 was unchanged at 4 m/min before and after the detachment. Therefore, the ratio R (=V1/V2) of the circumferential speed between the circumferential speed V1 of the conductive support 5 and the circumferential speed V2 of the applicator roll 61 at the time of detachment was adjusted to be 1.5. The conductive support 5 remained rotated for 20 seconds in the state where the applicator roll 61 was away from the cylindrical substrate 5. Thereafter, drying was performed at 120° C. for 30 minutes, so that a charge-generating layer coating film was formed. In this manner, an intermediate product of an electrophotographic photoreceptor of Example 3 in which the charge-generating layer coating film was formed on the intermediate layer coating film was produced.

Comparative Example 7

An intermediate product of an electrophotographic photoreceptor of Comparative Example 7 in which the charge-generating layer coating film was formed on the intermediate layer coating film was produced in the same manner as in Example 3 except that the circumferential speed V1 of the conductive support at the time of detaching the applicator roll and the conductive support from each other was 4 m/min, which was the same as the circumferential speed during application, that is, the ratio R of the circumferential speed was 1.0.

Example 4

First, 10 parts by weight of TPD shown by structural formula (I), which is a charge-transporting substance, 16 parts by weight of polycarbonate resin (manufactured by Mitsubishi Engineering-Plastics Corporation: Iupilone Z300), which was a binder resin, 1 part by weight of 2,6-di-t-butyl-4-methyl phenol and 0.006 parts by weight of diphenyl polysiloxane (manufactured by Shin-Etsu Chemical Co., Ltd.: KF-50) were dissolved in 42 parts by weight of toluene and 42 parts by weight of cyclohexanone, so that a coating liquid for forming a charge-transporting layer was prepared.

This coating liquid for forming a charge-transporting layer was applied onto the charge-generating layer previously formed in Example 3 by the application method of the invention using the application apparatus 1 of a reverse roll coating system shown in FIGS. 1 to 3. The circumferential speeds of the applicator roll 2, the metalling roll 13 and the conductive support 5 while transferring and applying the coating liquid on the charge-generating layer of the conductive support were 10 m/min. The gap between the metalling roll 13 and the applicator roll 2 was 100 μm, and the gap between the applicator roll 2 and the conductive support 5 was 80 μm.

First, application was started in the same manner as in Example 2 above while rotating all of the rolls 2, 13, and the conductive support 5. After the start of application, when the number of rotations of the conductive support 5 reached 2, the conductive support 5 was detached from the applicator roll 2 at a detachment rate of 50 mm/sec. The circumferential speed of the conductive support 5 was increased from 10 m/min to 20 m/min at the same time of the detachment. The circumferential speed of the applicator roll 2 was unchanged at 10 m/min before and after the detachment. Therefore, the ratio R of the circumferential speed between the circumferential speed V1 of the conductive support 5 and the circumferential speed V2 of the applicator roll 2 at the time of detachment was adjusted to be 2.0. The conductive support 5 remained rotated for 20 seconds in the state where the applicator roll 2 was away from the cylindrical substrate 5. Thereafter, drying was performed at 120° C. for one hour, so that a charge-transporting layer coating film was formed. In this manner, an electrophotographic photoreceptor of Example 4 in which the charge-transporting layer coating film was formed on the charge-generating layer coating film was produced.

Comparative Example 8

An electrophotographic photoreceptor of Comparative Example 8 in which the charge-transporting layer coating film was formed on the charge-generating layer coating film was produced in the same manner as in Example 4 except that the circumferential speed V1 of the conductive support at the time of detaching the applicator roll and the conductive support from each other was 10 m/min, which was the same as the circumferential speed during application, that is, the ratio R of the circumferential speed was 1.0.

Comparative Example 9

It was attempted to form a charge-transporting layer of Comparative Example 9 in the same manner as in Example 4 except that the circumferential speed V1 of the conductive support at the time of detaching the applicator roll and the conductive support from each other was 160 m/min, that is, the ratio R of the circumferential speed was 16.0. However, since the circumferential speed of the conductive support at the time of detachment was too high, the coating liquid was scattered from the surface of the conductive support and the obtained product was not usable as an electrophotographic photoreceptor.

Comparative Example 10

An electrophotographic photoreceptor of Comparative Example 10 in which the charge-transporting layer coating film was formed on the charge-generating layer coating film was produced in the same manner as in Example 4 except that the rotation of the conductive support was stopped immediately after the conductive support was detached from the applicator roll.

Comparative Example 11

An electrophotographic photoreceptor of Comparative Example 11 in which the charge-transporting layer coating film was formed on the charge-generating layer coating film was produced in the same manner as in Example 4 except that the circumferential speed u1 of the conductive support during application was 15 m/min, that is, the ratio r of the circumferential speed (=u1/u2) was 1.5, the gap between the metalling roll and the applicator roll was 120 μm, and the gap between the applicator roll and the conductive support was 95 μm.

Comparative Example 12

An electrophotographic photoreceptor of Comparative Example 12 in which the charge-transporting layer coating film was formed on the charge-generating layer coating film was produced in the same manner as in Example 4 except that the circumferential speed u1 of the conductive support during application was 6 m/min, that is, the ratio r of the circumferential speed (=u1/u2) was 0.6, the gap between the metalling roll and the applicator roll was 80 μm, and the gap between the applicator roll and the conductive support was 60 μm.

Example 5

First, 20 parts by weight of 2.5% acetic acid aqueous solution, 100 parts by weight of butyl carbitol and 50 parts by weight of methyl isobutyl ketone (MIBK) were mixed to 30 parts by weight of methyl trimethoxy silane and 5 parts by weight of dimethyl dimethoxy silane, and subjected to water-splitting reaction at room temperature for 16 hours. Thereafter, 1 part by weight of antioxidant (manufactured by Sankyo Co., Ltd.:Sanol LS2626), 5 parts by weight of a charge-transporting structural unit-containing compound shown by structural formula (II), 20 parts by weight of colloidal silica (dispersed in methanol, solid content of 30 mass %) and 1 part by weight of aluminum acetyl acetate as a curing catalyst were added and dissolved therein, so that a coating liquid for forming a protective layer was prepared.

This coating liquid for forming a protective layer was applied onto the charge-transporting layer formed on the conductive support by the application method of the invention using the application apparatus 60 of a natural roll coating system shown in FIG. 4. The circumferential speeds of the applicator roll 61, the metalling rolls 13, 63 and the conductive support 5 while transferring and applying the coating liquid on the conductive support were 6 m/min. The gap between the metalling roll 13 and the second metalling roll 63 was 70 μm, and the gap between the metalling roll 13 and the applicator roll 61 was 40 μm.

First, application was started in the same manner as in Example 2 while rotating all of the rolls 61, 13, 63 and the conductive support 5. After the start of application, when the number of rotations of the conductive support 5 reached 2, the conductive support 5 was detached from the applicator roll 61 at a detachment rate of 50 mm /sec. The circumferential speed of the conductive support 5 was increased from 6 m/min to 9.6 m/min at the same time of the detachment. The circumferential speed of the applicator roll 61 was unchanged at 6 m/min before and after the detachment. Therefore, the ratio R (=V1/V2) of the circumferential speed between the circumferential speed V1 of the conductive support 5 and the circumferential speed V2 of the applicator roll 61 at the time of detachment was adjusted to be 1.6. The conductive support 5 remained rotated for 20 seconds in the state where the applicator roll 61 was away from the cylindrical substrate 5. Thereafter, curing and drying were performed at 120° C. for 90 minutes, so that a protective layer coating film was formed. In this manner, an electrophotographic photoreceptor of Example 5 in which the protective layer coating film was formed was produced.

(II)

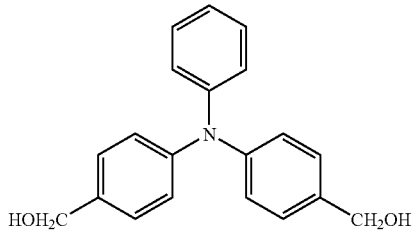

Comparative Example 13

An electrophotographic photoreceptor of Comparative Example 13 in which the protecting layer coating film was formed was produced in the same manner as in Example 5 except that the circumferential speed V1 of the conductive support at the time of detaching the applicator roll and the conductive support from each other was 6 m/min, which was the same as the circumferential speed during application, that is, the ratio R of the circumferential speed was 1.0.

Evaluation of Test 2

The film thickness distribution in the circumferential direction in the intermediate produces of each electrophotographic photoreceptor or the electrophotographic photoreceptors produced in Examples 2 to 5 and Comparative Examples 6 to 8 and 10 to 13, and the film thickness distribution in the axis direction of each electrophotographic photoreceptor produced Comparative Examples 11 and 12 were measured by multifunctional multichannel spectrophotometer (manufactured by Otsuka Electronics Co., Ltd.:MCPD2000). For the film thickness of the charge-generating layer coating film of Example 3 and Comparative Example 7, a Y value, which is one element of tristimulus values in an XYZ color system in the above apparatus was measured, and the thickness was obtained according to the calibration curve previously prepared based on the Y value.

Figure 10:
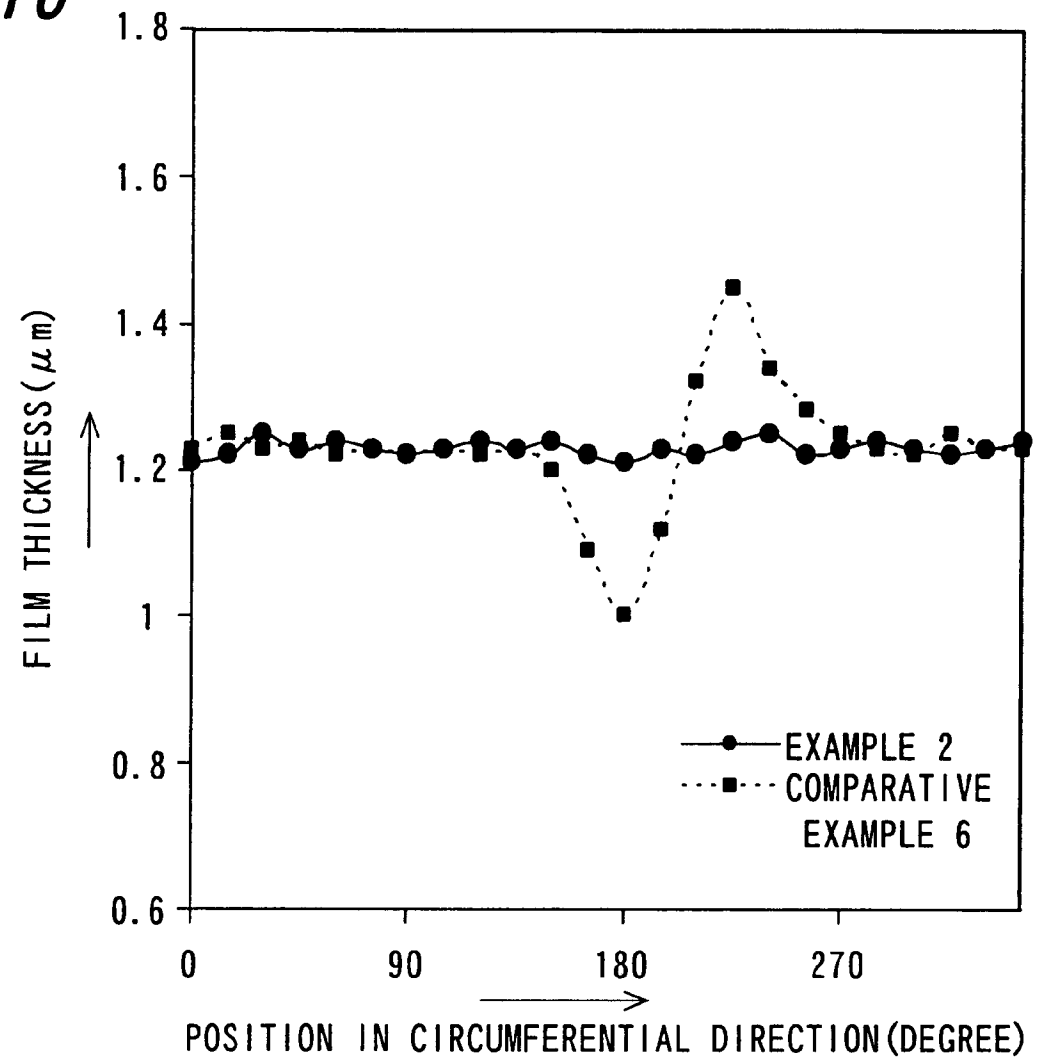
FIG. 10 is a graph showing the results of measurement of film thickness in the circumferential direction of an intermediate layer.
Figure 13:
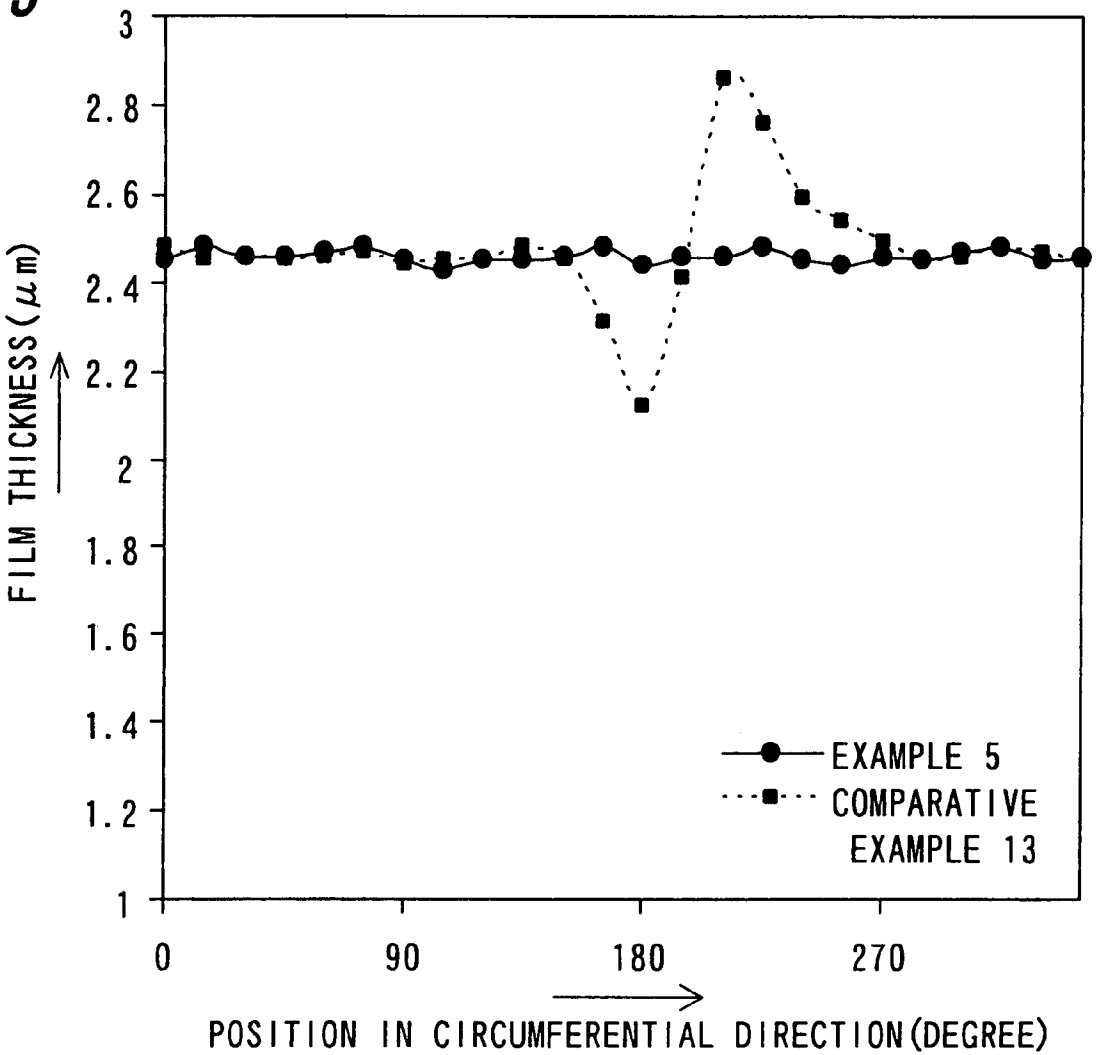
FIG. 13 is a graph showing the results of measurement of film thickness in the circumferential direction of a protective layer.
Figure 14:
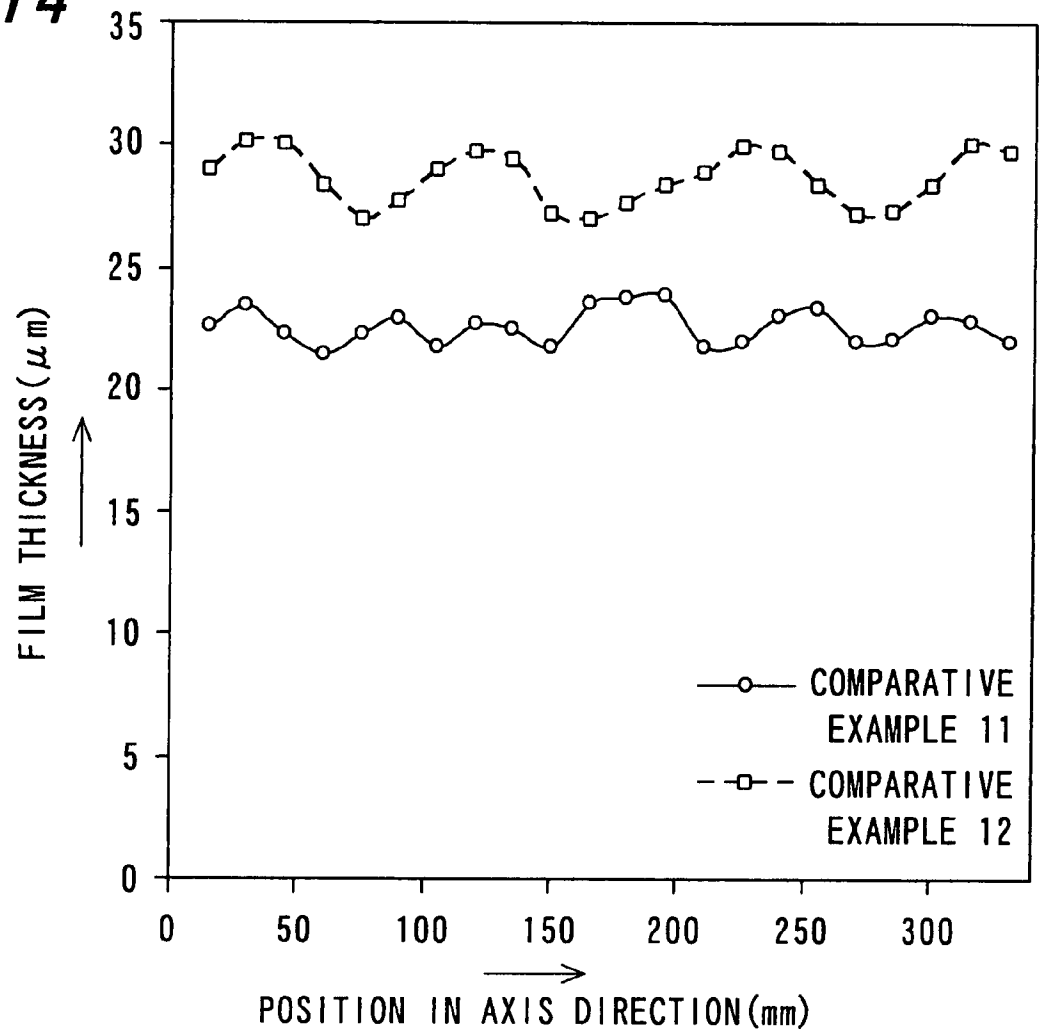
FIG. 14 is a graph showing the results of measurement of film thickness in the axis direction of the charge-transporting layer.

FIGS. 10 and 14 show the measurement results. FIG. 10 is a graph showing the results of measurement of film thickness in the circumferential direction of an intermediate layer, FIG. 11 is a graph showing the results of measurement of film thickness in the circumferential direction of a charge-generating layer, FIG. 12 is a graph showing the results of measurement of film thickness in the circumferential direction of a charge-transporting layer, FIG. 13 is a graph showing the results of measurement of film thickness in the circumferential direction of a protective layer and FIG. 14 is a graph showing the results of measurement of film thickness in the axis direction of the charge-transporting layer.

Figure 11:
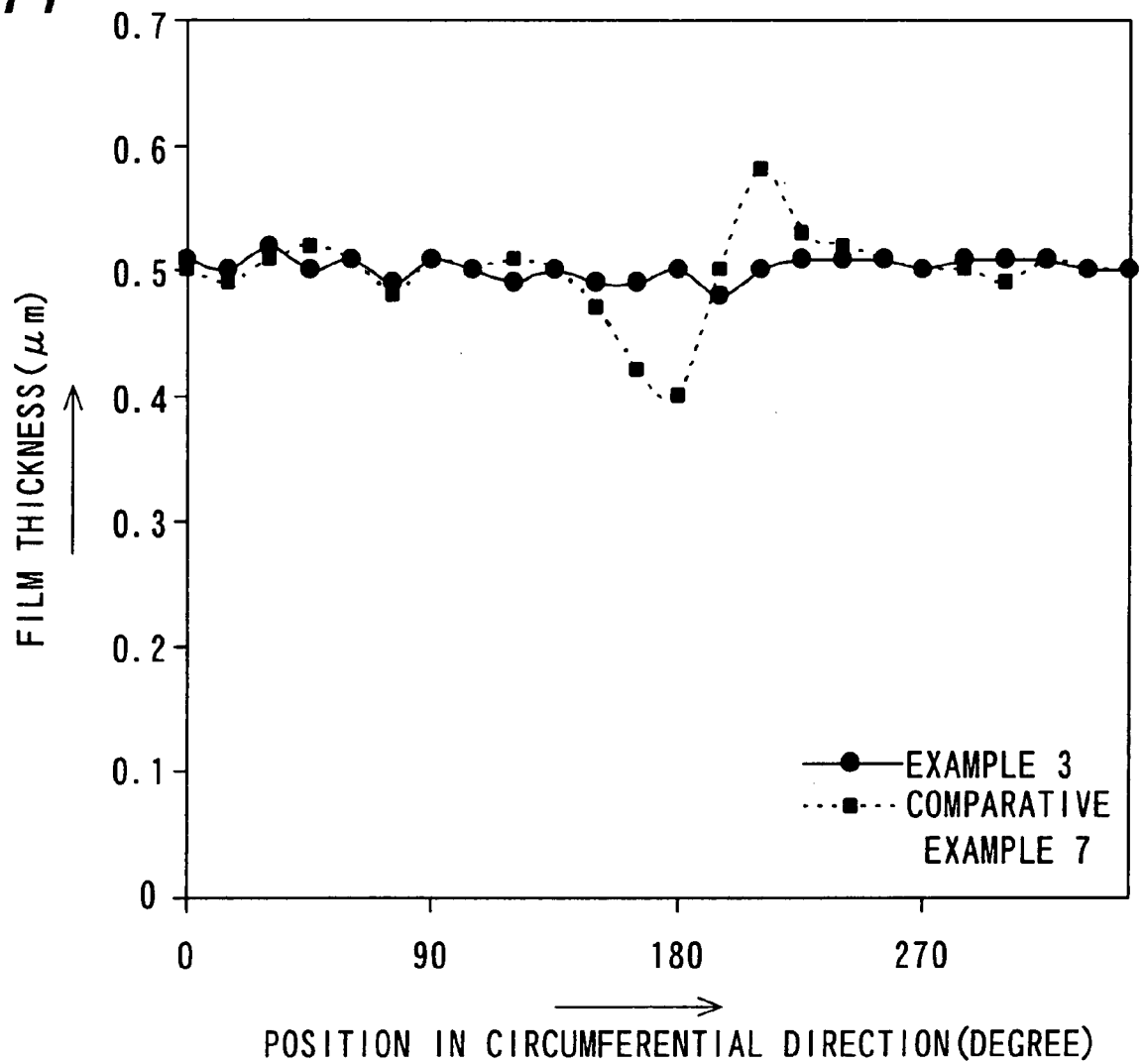
FIG. 11 is a graph showing the results of measurement of film thickness in the circumferential direction of a charge-generating layer.
Figure 12:
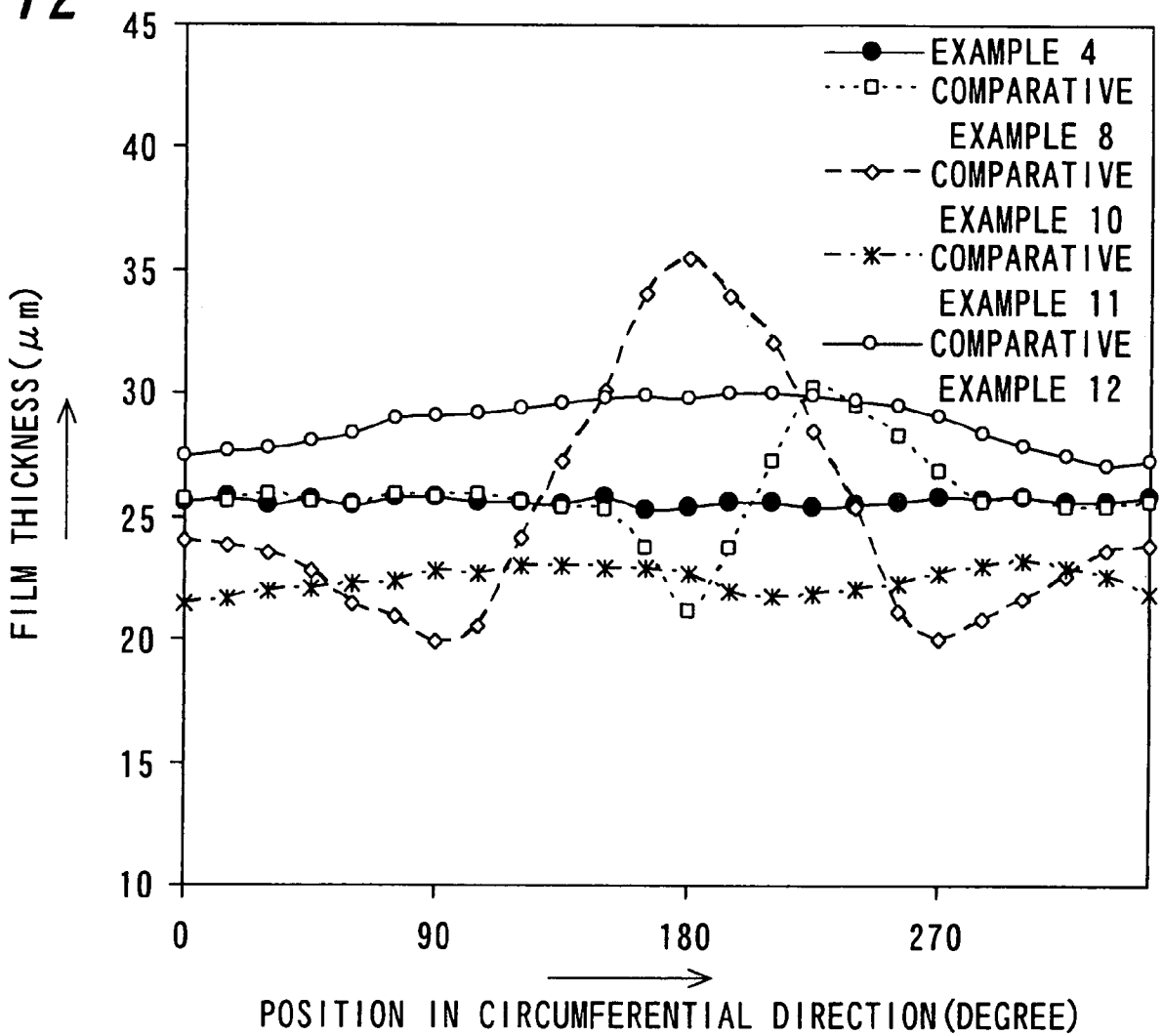
FIG. 12 is a graph showing the results of measurement of film thickness in the circumferential direction of a charge-transporting layer.

The comparison between Example 2 and Comparative Example 6 in FIG. 10, the comparison between Example 3 and Comparative Example 7 in FIG. 11, the comparison between Example 4 and Comparative Example 8 in FIG. 12, and the comparison between Example 5 and Comparative Example 13 in FIG. 13 made the following evident in all the cases where either the intermediate layer, the charge-generating layer, the charge-transporting layer or the protective layer is formed by application. When the applicator roll and the conductive support are detached from each other while the circumferential speeds of the conductive support and the applicator roll are the same, that is, the ratio R of the circumferential speed is 1.0, a large joint was generated. However, when the circumferential speed V1 of the conductive support is higher than the circumferential speed V2 of the applicator roll at the time of detaching the conductive support from the applicator roll as in the application method of the invention, generation of a joint was prevented, and a coating film having a uniform thickness was formed. This effect can be obtained regardless of natural roll coating or reverse coating.

As shown in Comparative Example 10, when the rotation of the conductive support was stopped immediately after the conductive support is detached from the applicator roll, the coating film on the conductive support dropped in the gravity direction, and the film thickness became significantly non-uniform. As shown in Comparative Examples 11 and 12, when the circumferential speed u1 of the conductive support during application was significantly different from the circumferential speed u2 of the applicator roll, that is, when the ratio r (=u1/u2) of the two speeds was far away from 1.0 such as 1.5 or 0.6, the state of the coating film becomes rough, a change in the film thickness that could not be ignored occurred, especially in the axis direction, although generation of a joint was suppressed.

Test 3

In test 3, the electrophotographic photoreceptors produced as the examples and the comparative examples were mounted on an image forming apparatus, and the quality of images formed by the electrophotographic photoreceptors was evaluated. The electrophotographic photoreceptors of the examples used for the test were Examples 1, 4, 5 as described above and Example 6 produced as follows. The electrophotographic photoreceptors of the comparative example used for the test were Comparative Examples, 1, 3 to 5 and 12.

Example 6

A coating liquid for forming an intermediate layer was prepared by adding 10 parts by weight of dendritic titanium oxide (manufactured by ISHIHARA SANGYO Co., Ltd.: TTO-D-1) whose surface had been treated with aluminum oxide (chemical formula: $Al_2O_3$) and zirconium dioxide (chemical formula: $ZrO_2$) and 10 parts by weight of copolymer nylon resin (manufactured by Toray Industries, Inc.: CM8000) to a mixed solvent of 42 parts by weight of ethanol, 38 parts by weight of butanol and 30 parts by weight of benzyl alcohol, and then dispersing the mixture for 12 hours by using a paint shaker.

This coating liquid for forming an intermediate layer was applied onto a cylindrical conductive support made of aluminum having a diameter of 30 mm and a total length of 340 mm by the application method of the invention using the application apparatus 60 of a natural roll coating system shown in FIG. 4.

The circumferential speeds of the applicator roll 61, the metalling rolls 13, 63 and the conductive support 5 while transferring and applying the coating liquid on the conductive support were 7 m/min. The gap between the metalling roll 13 and the second metalling roll 63 was 80 μm, and the gap between the metalling roll 13 and the applicator roll 61 was 40 μm.

First, application was started in the same manner as in Example 1 as described above while rotating all of the rolls 61, 13, 63 and the conductive support 5. After the start of application, when the number of rotations of the conductive support 5 reached 2, the conductive support 5 was detached from the applicator roll 61 at a detachment rate of 50 mm/sec. The circumferential speed of the conductive support 5 was increased from 7 m/min to 10.5 m/min at the same time of the detachment. The circumferential speed of the applicator roll 61 was unchanged at 7 m/min before and after the detachment. Therefore, the ratio R (=V1/V2) of the circumferential speed between the circumferential speed V1 of the conductive support 5 and the circumferential speed V2 of the applicator roll 61 at the time of detachment was adjusted to be 1.5. The conductive support 5 remained rotated for 20 seconds in the state where the applicator roll 61 was away from the cylindrical substrate 5, so that an intermediate layer coating film was formed.

Then, 5 parts by weight of oxotitanium phthalocyanine having a crystal structure showing a definite diffraction peak at least at a Bragg angle (2θ±0.2°) of 27.2° in the X-ray diffraction spectrum by Cu—Kα characteristic X-ray (wavelength: 1.54 Å) as oxotitanium phthalocyanine, which is a charge-generating substance, 3 parts by weight of polyvinyl butyral resin (manufactured by Sekisui Chemical Co., Ltd.: S-LEC BM-S), and 92 parts by weight of cyclohexanone were mixed, and the mixture was subjected to a dispersion treatment with a paint shaker, so that a coating liquid for forming a charge-generating layer was prepared. This coating liquid for forming a charge-generating layer was applied onto the previously formed intermediate layer by the immersion method of the invention using the application apparatus 60, so that a charge-generating layer having a thickness of 0.5 μm was formed on the intermediate layer.

The circumferential speed of the metalling roll 13 was 5 m/min, and the circumferential speeds of the applicator roll 61 and the conductive support 5 were 10 m/min while transferring and applying the coating liquid for forming a charge-generating layer on the intermediate layer. The gap between the metalling roll 13 and the second metalling roll 63 was 60 μm, and the gap between the metalling roll 13 and the applicator roll 61 was 30 μm.

After the start of application, when the number of rotations of the conductive support 5 reached 2, the conductive support 5 was detached from the applicator roll 61 at a detachment rate of 50 mm/sec. The circumferential speed of the conductive support 5 was increased from 10 m/min to 15 m/min at the same time of the detachment. The circumferential speed of the applicator roll 61 was unchanged at 10 m/min before and after the detachment. Therefore, the ratio R (=V1/V2) of the circumferential speed between the circumferential speed V1 of the conductive support 5 and the circumferential speed V2 of the applicator roll 61 at the time of detachment was adjusted to be 1.5. The conductive support 5 remained rotated for 20 seconds in the state where the applicator roll 61 was away from the cylindrical substrate 5, so that a charge-generating layer coating film was formed.

Furthermore, 10 parts by weight of TPD shown by structural formula (I), which is a charge-transporting substance, 16 parts by weight of polycarbonate resin (manufactured by Mitsubishi Engineering-Plastics Corporation: Iupilone Z300), which was a binder resin, 1 part by weight of 2,6-di-t-butyl-4-methyl phenol and 0.008parts by weight of diphenyl polysiloxane (manufactured by Shin-Etsu Chemical Co., Ltd.:KF-50) were dissolved in 40 parts by weight of toluene and 44 parts by weight of tetralin, so that a coating liquid for forming a charge-transporting layer was prepared. This coating liquid for forming a charge-transporting layer was applied onto the previously formed charge-generating layer by the application method of the invention using the application apparatus 60, and thus a charge-transporting layer having a thickness of 25 μm was formed on the charge-generating layer.

The circumferential speed of the metalling roll 13 was 25 m/min, and the circumferential speeds of the applicator roll 61 and the conductive support 5 were 15 m/min while transferring and applying the coating liquid for forming a charge-transporting layer on the charge-generating layer. The gap between the metalling roll 13 and the second metalling roll 63 was 160 μm, and the gap between the metalling roll 13 and the applicator roll 61 was 80 μm.

After the start of application, when the number of rotations of the conductive support 5 reached 2, the conductive support 5 was detached from the applicator roll 61 at a detachment rate of 50 mm/sec. The circumferential speed of the conductive support 5 was increased from 15 m/min to 30 m/min at the same time of the detachment. The circumferential speed of the applicator roll 61 was unchanged at 15 m/min before and after the detachment. Therefore, the ratio R (=V1/V2) of the circumferential speed between the circumferential speed V1 of the conductive support 5 and the circumferential speed V2 of the applicator roll 61 at the time of detachment was adjusted to be 2.0. The conductive support 5 remained rotated for 20 seconds in the state where the applicator roll 61 was away from the cylindrical substrate 5. Thereafter, drying was performed at 130° C. for one hour, so that a charge-transporting layer was formed. In this manner, an electrophotographic photoreceptor of Example 6 was produced.

Evaluation of Test 3

Each of the electrophotographic photoreceptors above was mounted on a compact digital copier (manufactured by Sharp: AR-450), which is an image forming apparatus. Half tone images were formed on a regular A3 paper sheet that is defined by Japanese Industrial Standard (JIS) P0138 by a compact digital copier on which each electrophotographic photoreceptor was mounted. Herein, "half tone images" refers to images in which darkness and lightness of images are represented by half-toning with black and white dots. The obtained images were visually observed, and the image defects and image quality were evaluated.

As a result, in all of the electrophotographic photoreceptors produced in Comparative Examples 1, 3 and 4, although there was a difference in the darkness, joint portions were definitely present as darkness and lightness on the images. In the electrophotographic photoreceptor produced in Comparative Example 5, although there was substantially no image defects in the joint portion, darkness and lightness on the images were present in the linear form in the axis direction of the electrophotographic photoreceptor, corresponding to the rib formed in the coating film. Also in the electrophotographic photoreceptor produced in Comparative Example 12, although there was substantially no image defects in the joint portion, darkness and lightness on the images due to non-uniformity of the film thickness were present in an island form. On the other hand, in the electrophotographic photoreceptors produced in Examples 1, and 4 to 6 of the invention, generation of joints and ribs was prevented, so that there was no image defect or darkness and lightness of images caused thereby, and the quality was as good as or more than that of the electrophotographic photoreceptor produced only by immersion coating.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An apparatus for applying a coating liquid to a cylindrical substrate by transferring the coating liquid supplied to an applicator roll from the applicator roll to the cylindrical substrate, comprising:

an applicator roll;

coating liquid supplying means for supplying a coating liquid to the applicator roll;

mounting means for mounting a cylindrical substrate removably thereon;

first driving means for rotating the cylindrical substrate mounted on the mounting means;

second driving means for rotating the applicator roll;

first circumferential speed detecting means for detecting a circumferential speed at which the cylindrical substrate is rotated;

second circumferential speed detecting means for detecting a circumferential speed at which the applicator roll is rotated;

rotation number detecting means for detecting a number of rotations of the cylindrical substrate;

detaching means capable of moving the cylindrical substrate so as to be close to or away from the applicator roll; and controlling means for controlling, in response to a detection output from the rotation number detecting means, a detection output from the first circumferential speed detecting means and a detection output from the second circumferential speed detection means, an operation of the detaching means so as to move the cylindrical substrate away from the applicator roll, and an operation of the first and the second driving means so that a circumferential speed of one of a circumferential speed at which the cylindrical substrate is rotated and a circumferential speed at which the applicator roll is rotated is higher than a circumferential speed of the other of the circumferential speed at which the cylindrical substrate is rotated and the circumferential speed at which the applicator roll.

2. The apparatus of claim 1, further comprising film thickness adjusting means for adjusting a film thickness of the coating liquid supplied to the applicator roll.

3. The apparatus of claim 2, wherein the film thickness adjusting means comprises a cylindrical member opposed to the applicator roll and an adjusting member for adjusting a gap between the cylindrical member and the applicator roll.

4. The apparatus of claim 1, wherein at least the surface layer of the applicator roll is made of an elastic material, while the coating liquid is transferred from the applicator roll to the cylindrical substrate, a rotation direction of the cylindrical substrate by the first driving means is opposite to a rotation direction of the applicator roll by the second driving means, and the cylindrical substrate and the applicator roll are arranged so as to come in contact with each other via the coating liquid.

* * * * *